US007686302B2

(12) United States Patent
Tanahashi et al.

(10) Patent No.: US 7,686,302 B2
(45) Date of Patent: Mar. 30, 2010

(54) FEEDER DEVICE FOR FEEDING MEDIA SHEETS

(75) Inventors: Naokazu Tanahashi, Nagoya (JP); Noritsugu Ito, Tokoname (JP); Wataru Sugiyama, Aichi-ken (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 542 days.

(21) Appl. No.: 11/613,133

(22) Filed: Dec. 19, 2006

(65) Prior Publication Data

US 2007/0152396 A1 Jul. 5, 2007

(30) Foreign Application Priority Data

Dec. 29, 2005 (JP) ..... 2005-380608

(51) Int. Cl.
*B65H 7/02* (2006.01)

(52) U.S. Cl. ..... 271/265.01; 271/10.05

(58) Field of Classification Search ..... 271/4.03, 271/10.03, 10.05, 265.01
See application file for complete search history.

(56) References Cited

U.S. PATENT DOCUMENTS 5,076,567 A * 12/1991 Sasaki et al. ..... 271/265.02
5,220,266 A * 6/1993 Kobayashi ..... 318/799
5,748,206 A * 5/1998 Yamane ..... 347/37
6,111,384 A * 8/2000 Stagnitto ..... 318/602
6,298,778 B1 * 10/2001 Onodera et al. ..... 101/232
6,528,962 B1 * 3/2003 Igarashi et al. ..... 318/461
6,650,436 B1 * 11/2003 Hamamoto et al. ..... 358/1.9
6,747,429 B2 * 6/2004 Igarashi ..... 318/560
6,761,351 B1 * 7/2004 Howe ..... 271/3.15
6,788,440 B1 * 9/2004 Sashida ..... 358/498
7,075,262 B2 * 7/2006 Igarashi ..... 318/560
7,156,387 B2 * 1/2007 Hidaka et al. ..... 271/10.02
2001/0035603 A1 * 11/2001 Graves et al. ..... 271/265.01
2003/0118360 A1 6/2003 Joichi et al.
2003/0156150 A1 * 8/2003 Hayashi et al. ..... 347/19

(Continued)

FOREIGN PATENT DOCUMENTS

JP H05-092843 A 4/1993

(Continued)

*Primary Examiner*—Patrick H Mackey
*Assistant Examiner*—Howard Sanders
(74) *Attorney, Agent, or Firm*—Baker Botts L.L.P.

(57) ABSTRACT

A feeder device for feeding media sheets along a feed path, including: (a) an accommodator for accommodating the media sheets; (b) a feed mechanism including (b-1) a roller that is to be held in contact with the media sheets accommodated in the accommodator and (b-2) a motor that is controllable based on a variable so as to rotate the roller, so that the media sheets can be fed along the feed path by the roller; (c) a detector operable to detect an amount of rotation of the roller or the motor; (d) a controller operable to adjust the variable on the basis of the amount of rotation detected by the detector such that feed movement of each media sheet can be achieved substantially as desired; (e) a monitor operable to monitor the variable that is adjusted by the controller; and (f) a media-related information obtainer operable to obtain information related to the media sheets fed by the feed mechanism, based on the actual value of the adjusted variable monitored by the monitor.

24 Claims, 13 Drawing Sheets

U.S. PATENT DOCUMENTS

2003/0184002 A1* 10/2003 Akiyama et al. ..... 271/110
2004/0197126 A1* 10/2004 Igarashi ..... 400/582

FOREIGN PATENT DOCUMENTS

JP H05-132191 A 5/1993
JP H05-186092 A 7/1993
JP H06-080277 A 3/1994
JP H06-199469 A 7/1994
JP H09-301572 A 11/1997
JP 2003-182882 A 7/2003
JP 2003-312893 A 11/2003

* cited by examiner

FEEDER DEVICE FOR FEEDING MEDIA SHEETS

This application is based on Japanese Patent Application No. 2005-380608 filed on Dec. 29, 2005, the content of which is incorporated hereinto by reference.

BACKGROUND OF THE INVENTION

1. Field of the Invention

The present invention relates to a feeder device used in an image forming or document feeding apparatus such as printer and facsimile apparatus, for feeding stacked media sheets one after another along a feed path.

2. Discussion of Related Art

Conventionally, a document feeding apparatus such as printer and facsimile apparatus is equipped with a sheet feeder as a feeding device in which a plurality of recording paper sheets as media sheets stacked on a sheet supply tray are separated one by one from the supply tray, so as to fed along a feed path.

In the sheet feeder, the paper sheets are fed one after another along the feed path, by rotation of a sheet supply roller that is held in contact with an uppermost one of the paper sheets stacked on the sheet supply tray. Commonly, a DC motor is used as a drive source for driving the sheet supply roller, so that the sheet supply roller is rotated with the DC motor being driven in response to a drive command that is supplied to the DC motor.

The DC motor inherently has an advantage that its operating noise is relatively low. However, the DC motor tends to suffer from fluctuation in its rotational velocity that could be caused by, for example, disturbance such as electromagnetic wave and fluctuation in load acting on the sheet supply roller. Therefore, the sheet feeder is equipped with a feedback control system for supplying a variable that is suitably determined by comparing a detected value of a rotational velocity of the sheet supply roller with a reference value of the rotational velocity of the sheet supply roller, so that the DC motor can be controlled based on the suitable variable.

In the conventional sheet feeder as described above, it is determined whether jamming or other sheet feed error occurs by monitoring change in output signals supplied from sensors such as feed sensor and register sensor that are disposed in suitable portions of the feed path along which the paper sheet is to be fed.

Further, JP-2003-312893A discloses a sheet feeder that is equipped with a detector for detecting jamming or other sheet feed error by comparing a monitored value of an electric current supplied to a DC motor with a predetermined threshold value of the supplied electric current. This arrangement is based on a fact that the electric current supplied to the DC motor is increased with increase of a load acting on the DC motor, which increase could be caused by reduction or stop of rotation of a sheet supply roller, for example, in event of occurrence of jamming or other sheet feed error.

The load acting on the DC motor is fluctuated by a friction acting between the sheet supply roller and the recording paper sheet that are in contact with each other. An amount of this friction varies depending upon a kind or type of the paper sheet. For example, the load acting on the DC motor is larger when a paper sheet having larger thickness and weight is supplied, than when a paper sheet having smaller thickness and weight is supplied. Further, a study revealed that the load varies depending upon whether the paper sheet is a glossy paper or a standard paper, and that load is larger in supply of the glossy paper than in supply of the standard paper even if the glossy paper and the standard paper are the same with respect to thickness. However, in the sheet feeder disclosed in the above-identified published document, the variation of the load depending upon the type of the paper sheet is not taken into account, so that there is a possibility of erroneous determination of sheet feed error, depending on the type of the paper sheet accommodated in a sheet supplying cassette, even when the recording paper sheet is being normally fed.

Further, in the disclosed sheet feeder, it is possible to detect substantially three kinds of error statuses such as absence of the paper sheet, feed failure due to slip motion of the sheet supply roller, and paper jamming. However, there has been a need for detection of other kind of error status.

SUMMARY OF THE INVENTION

The present invention was made in view of the background prior art discussed above. It is therefore an object of the invention to provide a feeder device capable of obtaining information related to media sheets that are to be fed, by monitoring a variable such as a value related to an electric power supplied to an electric motor.

This object may be achieved by the invention, which provides a feeder device for feeding media sheets one after another along a feed path, including: (a) an accommodator capable of accommodating the media sheets stacked therein; (b) a feed mechanism including (b-1) a roller that is to be held in contact with the media sheets stacked in the accommodator and (b-2) an electric motor that is controllable based on a controlled variable so as to rotate the roller, so that the media sheets can be fed along the feed path by the roller which is held in contact with the media sheets and which is rotated by the electric motor; (c) a detector operable to detect an amount of rotation of one of the roller and the electric motor; (d) a controller operable to adjust the controlled variable on the basis of the amount of rotation detected by the detector such that feed movement of each of the media sheets along the feed path can be achieved substantially as desired; (e) a monitor operable to monitor an actual value of the controlled variable that is adjusted by the controller; and (f) a media-related information obtainer operable to obtain information related to the media sheets fed by the feed mechanism, based on the actual value of the adjusted variable monitored by the monitor.

The above-described term "obtaining information related to the media sheet" encompasses determining a type of the media sheets. In this sense, the above-described media-related information obtainer may include a media-type determiner operable to determine a type of the media sheets fed by the feed mechanism, based on the actual value of the adjusted variable monitored by the monitor. The media sheets are held in pressing contact with the rotated roller by a pressing force that varies depending upon the type of the media sheets fed by the feed mechanism. For example, the pressing force is larger where the media sheets are glossy papers, than where the media sheets are standard papers. Such a difference in the pressing force leads to change in the variable based on which the electric motor is controlled. It is therefore possible to determine the type of the media sheets fed by the feed mechanism, by monitoring the actual value of the variable that is adjusted by the controller. In the feeder device constructed according to the first aspect of the invention, the type of the media sheets fed by the feed mechanism are determined by the media-type determiner, based on the actual value of the adjusted variable monitored by the monitor. It is noted that the variable (based on which the electric motor is controllable) may be a value related to an electric power adjustable by changing, for example, a duty ratio of PWM signal, an electric current or an electric voltage that is supplied or applied to the electric motor.

The present feeder device makes it possible to inform a user of the type of the media sheets that is determined by the media-type determiner, and/or to carry out a printing operation in one of different modes that is suitably selected according to the determined type of the media sheets. Further, where the media sheets actually stacked in the accommodator are different in type from those are predetermined according to a printing condition, it is possible to inform the user of the fact that the actually stacked media sheets are different in type from the predetermined sheets, and/or to suspend the printing operation. Thus, with the determination of the type of the media sheets before the printing operation performed on the media sheet, the information as to the determined type of the media sheets can be utilized for various procedure steps.

The above-described term "obtaining information related to the media sheet" further encompasses determining an amount of the media sheets. In this sense, the above-described media-related information obtainer may include, in addition to or in place of the above-described media-type determiner, a remaining-amount determiner operable to determine an amount of the media sheets remaining in the accommodator, based on the actual value of the adjusted variable monitored by the monitor.

The media sheets are picked up by the rotated roller by a so-called pickup force that varies depending upon the amount of the media sheets remaining in the accommodator. For example, the pickup force is larger where the remaining amount of the media sheets is large, than where the remaining amount of the media sheets is small. Such a difference in the pickup force leads to change in the variable based on which the electric motor is controlled. It is therefore possible to determine the remaining amount of the media sheets, by monitoring the actual value of the variable that is adjusted by the controller.

BRIEF DESCRIPTION OF THE DRAWINGS

The above and other objects, features, advantages and technical and industrial significance of the present invention will be better understood by reading the following detailed description of presently preferred embodiment of the invention, when considered in connection with the accompanying drawings, in which.

DETAILED DESCRIPTION OF THE PREFERRED EMBODIMENT

Figure 1:
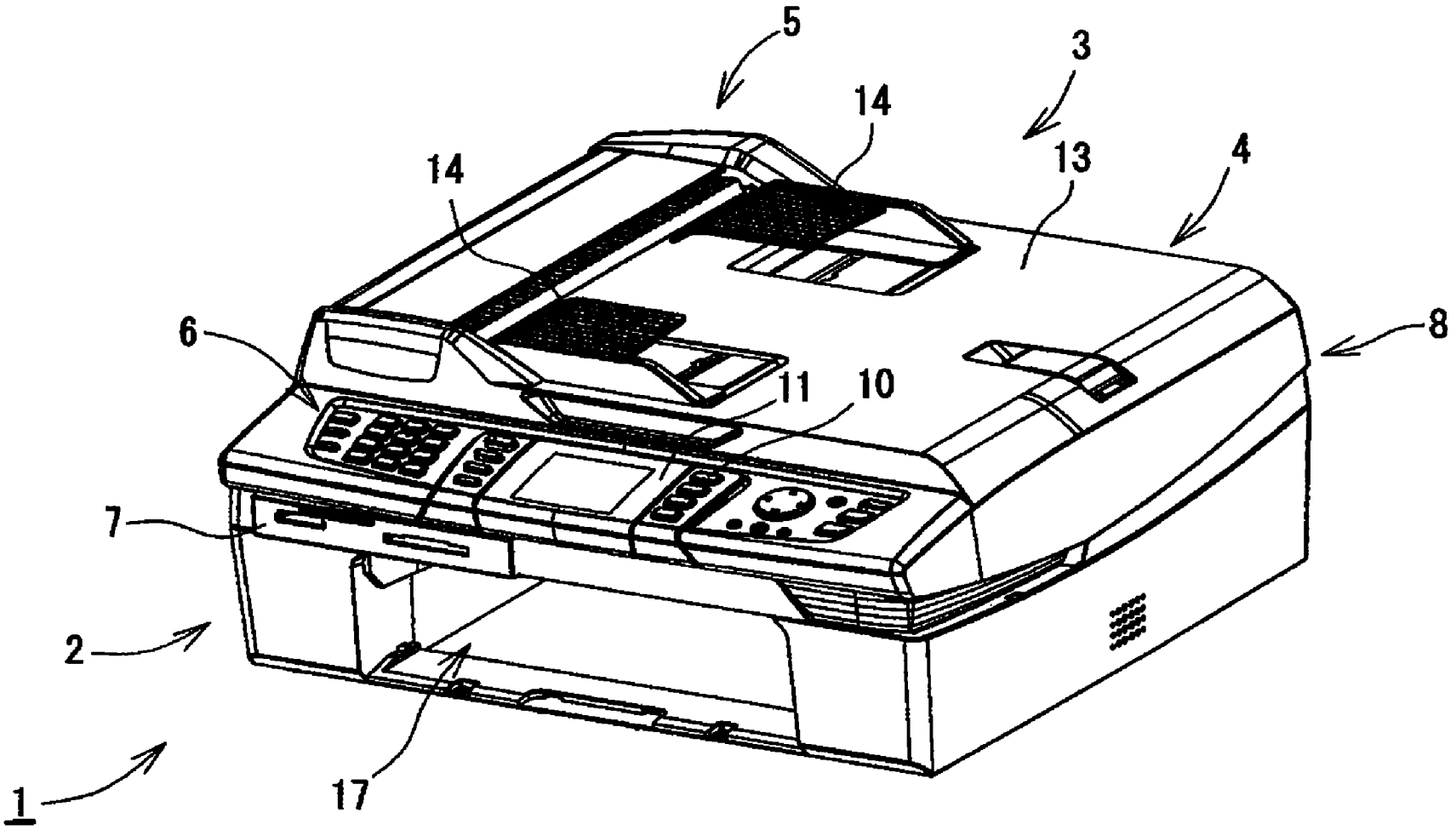
FIG. 1 is a perspective view showing a multifunction device 1 equipped with a sheet feeder 18 as a feeding device of the present invention.

There will be described an embodiment of the present invention, with reference to the accompanying drawings. FIG. 1 is a perspective view showing an appearance of a multifunction device (MFD) 1 equipped with a sheet feeder 18 (see FIG. 2) as a feeding device of the present invention. The multifunction device 1 includes a printer portion 1 constituted by a lower portion of the device 1, a scanner portion 3 disposed above the printer portion 2, a document cover 4 disposed above the scanner portion 3, an operator's control panel 6 disposed on a front portion of an upper surface of a main body of the device 1, and a slot portion 7 disposed in a front surface of the main body of the device 1. Thus, the multifunction device 1 has various functions such as a printer function, a scanner function, a copy function and a facsimile function.

The present multifunction device 1 is connected directly to external devices (not shown) such as personal computer (PC), memory card and USB (Universal Serial Bus) memory. The printer portion 2 is operated to record image or script on a recording paper sheet as media sheet, according to recording data (including data indicative of the image or script) supplied from the external devices. Further, the multifunction device 1 is capable of transferring image data read by the scanner portion 3, to the external devices, and also performing a so-called copy function for causing the printer portion 2 to record image that is read by the scanner portion 3, without transmission of data between the device 1 and the external devices. Moreover, the multifunction device 1 serves as a peripheral device allowing the PC to access a memory card that is connected to the device 1, when the device 1 and the PC are connected to each other for establishing data communication therebetween. Hereinafter, there will be described major components of the multifunction device 1. It should be noted that the device 1 described below is merely an example and that the device 1 may be modified as needed without departing from the sprit and scope of the present invention.

(Control Panel)

The operator's control panel 6 is disposed on the front portion of the upper surface of the main body of the multifunction device 1, namely, on an upper side of a front portion of the scanner portion 3, so that the printer portion 2 and the scanner portion 3 can be operated by an operator through the control panel 6. The control panel 6 is equipped with various operation keys 10 and a liquid-crystal display (LCD) 11. Each of the various functions incorporated in the device 1 is controlled to be operated according to commands input by the user through the control panel 6. As described above, when the device 1 is connected to the PC, the device 1 is operated according to commands supplied from the PC through an interface such as printer driver and scanner driver.

(Slot Portion)

The slot portion 7 is disposed in the front surface of the main body of the multifunction device 1, so that a small-sized memory card as storage medium can be inserted in a slot opening in the slot portion 7. In the device 1, image data stored in the small-sized memory card (that is inserted in the slot of the slot portion 7) are read out, and information represented by the image data is displayed on the LCD 11 of the control panel 6, so that an image selected by the user who sees the information displayed in the LCD 11 can be recorded on a paper sheet by the printer portion 3. In this instance, the selection of the image data to be recorded can be made through the control panel 6.

(Scanner Portion)

As shown in FIG. 1, in the scanner portion 3, the document cover 4 equipped with an automatic document feeder (ADF) 5 is provided to be pivotable about a hinge that is located in a rear end of an upper face of the main body of the multifunction device 1. By pivot motion of the document cover 4, it is possible to open and close a document mount base 8 which serves as FBS (Flatbed Scanner) and which is constituted by a part of an upper portion of the main body of the device 1.

In the document mount base 8, there is disposed an image reading unit that is operable to read an image formed on a document. The image reading unit has a well-known construction, and is constructed to include, for example, a CIS (Contact Image Sensor) operable to read the image formed on the document disposed on a contact glass (not shown) that constitutes the upper surface of the document mount base 8, and a belt drive mechanism operable to reciprocate the CIS below the contact glass. The CIS is a so-called contact-type line image sensor that is arranged to irradiate an outgoing light (emitted from a built-in light source) to the document, and then to guide a reflected light (emitted from the document) to a light receiver element (photoelectric converter element) through a built-in lens. The light receiver element outputs an electric signal generated based on a strength of the reflected light (such as brightness and quantity of light), whereby the image can be read. It is noted that the CIS may be replaced by other image sensor such as CCD (Charged Coupled Device) and CMOS (Complementary Metal-Oxide Semiconductor).

When the scanner portion 3 is used as the FBS, the image formed on the document that is disposed on the contact glass (constituting the upper surface of the document mount base 8) is read by the CIS that is reciprocated below the contact glass.

The ADF 5 incorporated in the document cover 4 is arranged to take the documents one after another, which are stacked on a document supply tray 13, so as to successively feed the documents toward a document exit tray 14 along a document feed path. Thus, the scanner portion 3 is used not only as the FBS but also as means for reading the image formed on the document that is moved by the ADF 5 in a sub-scanning direction. The present invention can be carried out without particular limitations on constructions of the scanner portion 3 and the ADF 5, redundant description of which is not provided in the present specification. It should be noted that the feeder device of the present invention is not necessarily provided for feeding recording paper sheets stacked on a sheet supply tray 20 (described below) but may be provided for feeding original document sheets along the document feed path defined in the ADF 5.

(Printer Portion)

Figure 2:
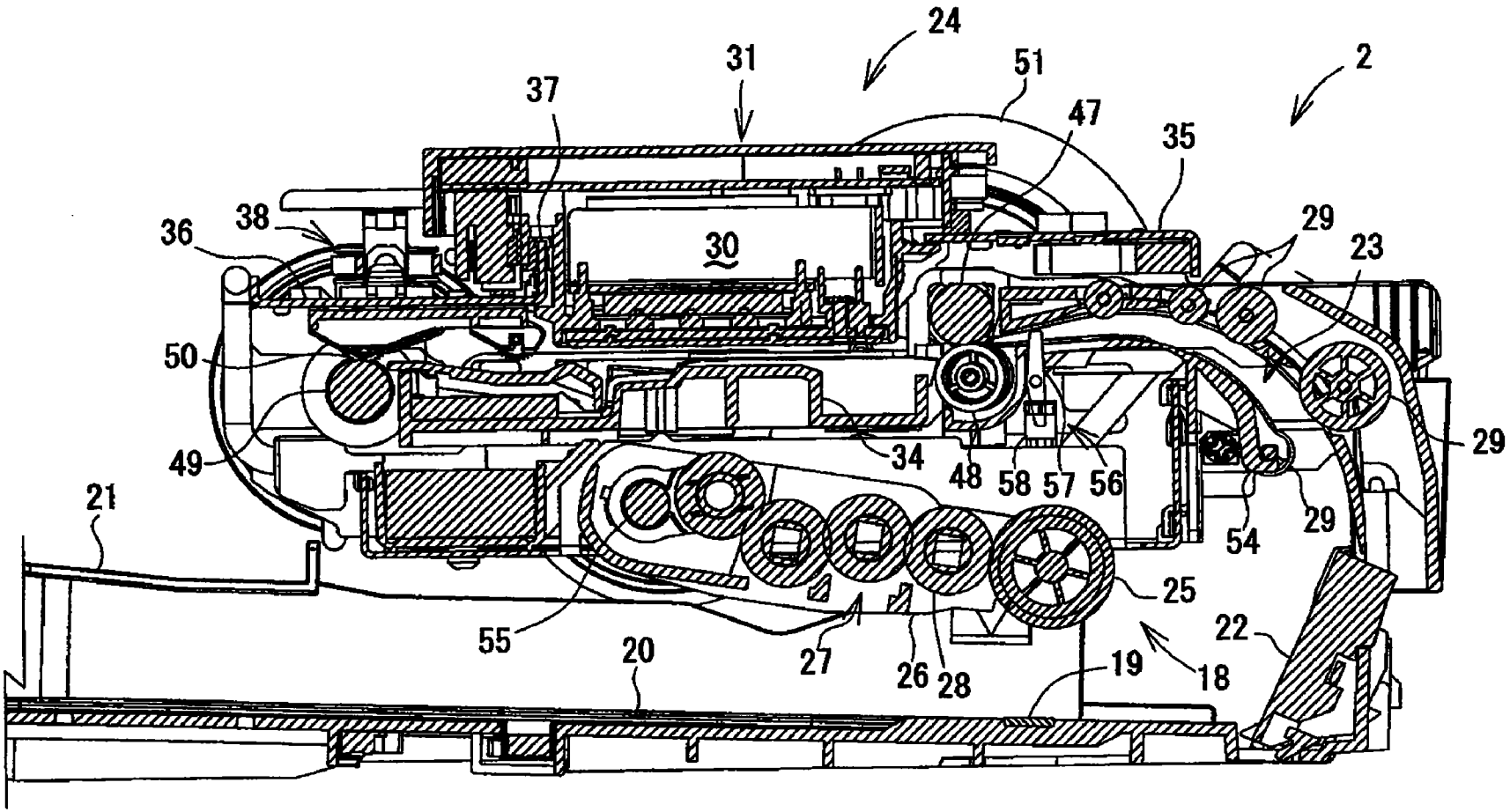
FIG. 2 is a cross sectional view showing a main construction of a printer portion 2 of the multifunction device 1.
Figure 3:
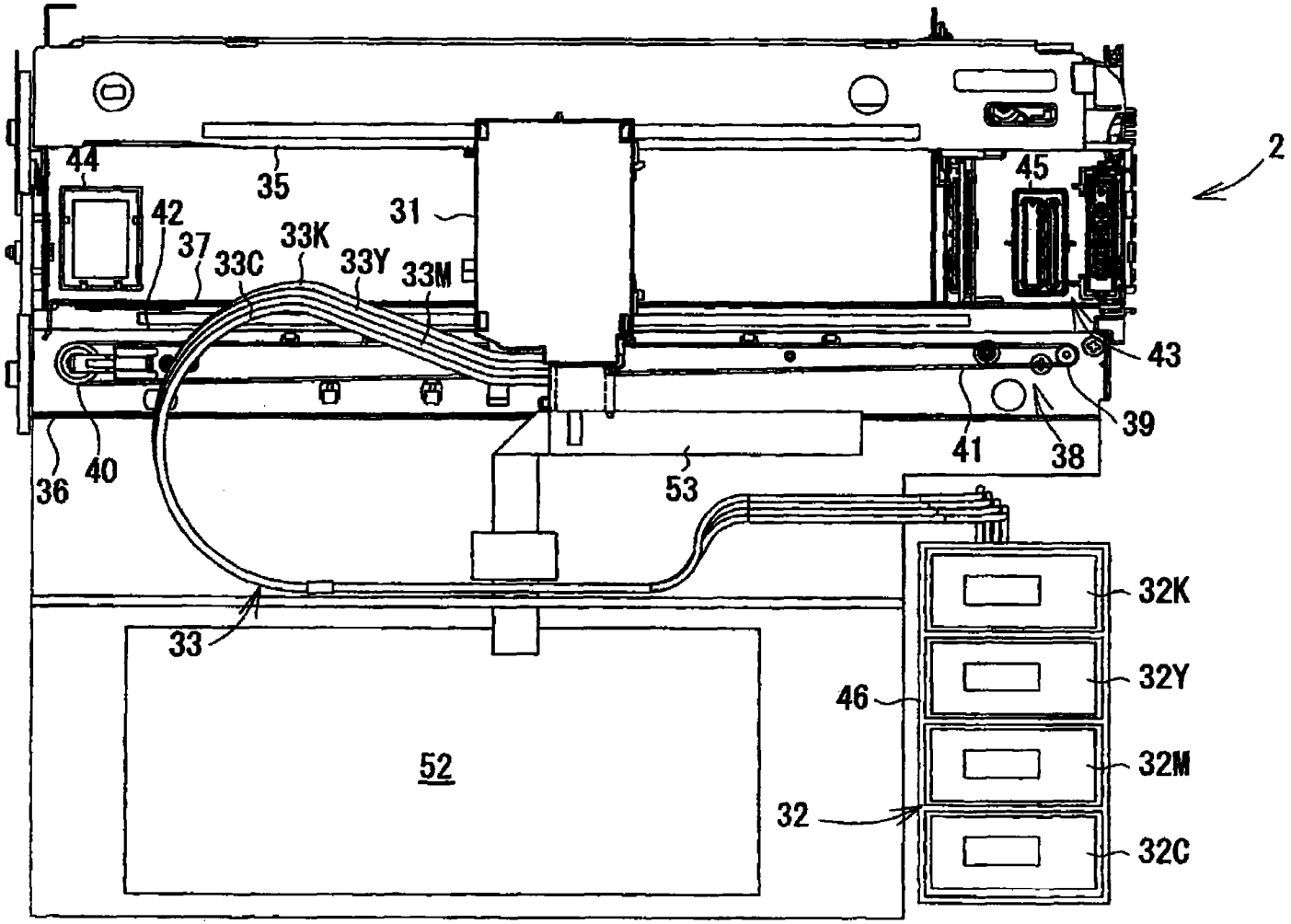
FIG. 3 is a plan view showing the printer portion 2 when a scanner portion 3 is removed from the multifunction device 1.

There will be next described construction of the printer portion 2, with reference to FIGS. 1-3. FIG. 2 is a cross sectional view showing a main construction of the printer portion 2. FIG. 3 is a plan view showing the printer portion 2 when the scanner portion 3 is removed from the multifunction device 1. As shown in FIG. 2, the printer portion 2 is constituted principally by an image recording portion 24 and the sheet feeder 18 as the feeding device. The image recording portion 24 is constituted by an inkjet recording head 30 and a scanning carriage 31, while the sheet feeder 18 is constituted by a sheet supply roller 25, a sheet supply arm 26, a drive-force transmission mechanism 27 and a sheet feed path 23.

As shown in FIG. 1, an opening 17 is formed in a front portion of the main body of the multifunction device 1, so that the sheet supply tray 20 as an accommodator and a sheet exit tray 21 (see FIG. 2) can be introduced into the main body of the device 1 through the opening 7. It is noted that FIG. 1 shows the device 1 when the sheet supply and exit trays 20, 21 are removed from the device 1.

The sheet supply tray 20 accommodates the media sheets in the form of recording paper sheets of a desired size such as A4 and B5, such that the media sheets are stacked in the sheet supply tray 20. The user of the multifunction device 1 accommodates a certain type of paper sheets in the sheet supply tray 20, which type is selected according to a desired quality of recorded image. For example, when the user wishes an image recording to be made at photo-quality level, glossy papers as the paper sheets are accommodated in the sheet supply tray 20. When the user wishes an image recording to be made at color-text level, inkjet recording papers as the paper sheets are accommodated in the sheet supply tray 20. When the user wishes an image recording to be made at monochrome-text level, standard papers as the paper sheets are accommodated in the sheet supply tray 20. As shown in FIG. 2, with the sheet supply tray 20 being introduced into the main body of the device 1, the paper sheets of legal size accommodated in the sheet supply tray 20 are disposed in the main body of the device 1 such that a longitudinal direction of the paper sheets coincides with a depth direction of the main body of the device 1 (that corresponds to the horizontal direction as seen in FIG. 2). The sheet exit tray 21 is supported by the sheet supply tray 20, and is disposed above the sheet supply tray 20. Thus, the sheet supply tray 20 and the sheet exit tray 21 superposed on each other to constitute a double-deck tray that is introduced in the device 1.

A slant sheet-separator plate 22 is disposed in a rear end portion of the sheet supply tray 20 that is introduced in the main body of the multifunction device 1, so that the paper sheets stacked in the sheet supply tray 20 can be separated one by one and guided upward by the sheet-separator plate 22. Thus, the sheet-separator plate 22 serves to prevent multi-feed of the paper sheets.

Above the sheet-separator plate 22, the sheet feed path 23 is defined to have a U-shaped cross sectional shape as seen in FIG. 2. The sheet feed path 23 extends upwardly from the sheet-separator plate 22, and is then curved to extend from a rear portion of the main body toward a front portion of the main body. The sheet feed path 23 passes through a space below the image recording portion 24, i.e., the space between the recording head 30 and a platen 34 that is described below, so as to reach the sheet exit tray 21. Each of the paper sheets is supplied from the sheet supply tray 20 is guided by the sheet feed path 23, so as to reach the image recording portion 24 after being moved from a lower portion of the main body toward an upper portion of the main body in a U-turn manner. Each paper sheet is discharged to the sheet exit tray 21 after an image is recorded on the paper sheet by the image recording portion 24.

When the sheet supply tray 20 is introduced in the main body of the multifunction device 1 through the opening 17, the sheet feeder 18 is positioned above the sheet supply tray 20 as shown in FIG. 2. The sheet feeder 18 includes, in addition to the sheet supply roller 25 and the drive-force transmission mechanism 27, a sheet supply motor 81 as an electric motor (see FIG. 6) and a pulse transmitter 82 as a supply-roller rotation detector (see FIG. 6).

The sheet supply roller 25 separates an uppermost one of the paper sheets stacked on the sheet supply tray 20, from the other stacked paper sheets, so as to supply the paper sheets one after another to the sheet feed path 23. The sheet supply roller 25 is rotatably held by a distal end portion of the sheet supply arm 26 that is vertically displaceable toward and away from the sheet supply tray 20. The sheet supply roller 25 is connected to the drive-force transmission mechanism 27 that is constituted by a plurality of gears meshing with each other. The sheet supply motor 81 provided by a DC motor is also connected to the drive-force transmission mechanism 27. Therefore, with the sheet supply motor 81 being driven, a drive force generated by the motor 81 is transmitted to the sheet supply roller 25 through the drive-force transmission mechanism 27, whereby the sheet supply roller 25 is rotated. In the present embodiment, the sheet supply roller 25 and the sheet supply motor 81 cooperated with each other to constitute a feed mechanism.

The pulse transmitter 82 is provided in a gear 28 which is one of the gears of the drive-force transmission mechanism 27 and which is adjacent to the sheet supply roller 25, for detecting a rotational velocity (i.e., rotational amount) of the sheet supply roller 25. The pulse transmitter 82 emits a continuous light such as laser and ultraviolet light, and receives the light reflected by a reflector plate, so as to output a pulse-shaped electric voltage or current signal (hereinafter referred to as "pulse signal") at a timing of reception of the reflected light. The pulse signal has a frequency corresponding to the rotational velocity (i.e., rotational amount) of the sheet supply roller 25. The reflector plate is attached to a side surface of the gear 28. The pulse transmitter 82 is fixed in such a position that enables the light to be emitted toward the reflector plate in a direction substantially perpendicular to the reflector plate. The pulse signal outputted by the pulse transmitter 82 is inputted to a motor controller 70 that is described below. The pulse transmitter 82 may be attached to any one of the gears of the drive-force transmission mechanism 27 such as a gear connected directly to an output shaft of the sheet supply motor 81. However, for accurately detecting the rotational speed of the sheet supply roller 25, it is preferable that the pulse transmitter 82 is fixed to the gear 28 that is the closest to the sheet supply roller 25. It should be noted that the pulse transmitter 82 is merely an example of the supply-roller rotation detector. The pulse transmitter 82 may be replaced, for example, by an optical encoder, a direct current tachogenerator, or a FG sensor (frequency generator) using a multipole pattern coil. Where the supply-roller rotation detector is provided by the optical encoder, it may be constituted by, for example, ones like an encoder disk 51 and a photo interrupter that are provided for a sheet feed roller 47 that is described below.

A cork piece 19 as a friction element is disposed in a portion of a bottom of the sheet supply tray 20, which portion is opposed to the sheer supply roller 25. That is, the cork piece 19 is positioned in such a position that the cork piece 19 is brought into contact with an outer circumferential surface of the sheet supply roller 25, before the paper sheets are set in the sheet supply tray 20 introduced in the main body of the multifunction device 1, or after all the paper sheets accommodated in the sheet supply tray 20 have been supplied. A friction acting between the cork piece 19 and the outer circumferential surface of the sheet supply roller 25 or between the cork piece 19 and a lowermost one of the paper sheets is larger than a friction acting between the paper sheets. Since the sheet supply tray 20, which is made of resin or the like, has a coefficient of friction in its bottom surface, there has been a problem that the paper sheets accommodated in the sheet supply tray 20 could be slid on the bottom surface of the tray 20 thereby causing multi-feed of the paper sheets. However, owing to provision of the cork piece 19 on the bottom surface of the sheet supply tray 20, the problematic multi-feed of the paper sheets can be restrained in the present multifunction device 1. It is noted that the cork piece 19 may be replaced by other slip-preventer element such as rubber and felt that performs the same function as the cork piece 19.

The sheet supply arm 26 is arranged to be pivotable about a shaft 55 that located in its proximal end portion, such that the distal end portion of the arm 26 is displaceable in the vertical direction. The arm 26 is held by the shaft 55 such that an inclination angle è defined between the arm 26 and the bottom surface of the sheet supply tray 20 (or defined between the arm 26 and the upper most one of the paper sheets accommodated in the sheet supply tray 20) is an acute angle. The arm 26 is biased downwardly by its own weight and a biasing spring (not shown). When the sheet supply tray 20 is being introduced into the main body of the device 1 through the opening 17, the distal end portion of the arm 26 is raised by the slant sheet-separator plate 22 disposed in a leading end portion of the tray 20, and then a vane portion (not shown) as a cam follower portion provided in the arm 26 is raised by a guide portion (not shown) as a cam portion provided in the tray 20. When the tray 20 is further introduced into the main body of the device 1, the sheet supply roller 25 rotatably fixed to the distal end portion of the arm 26 is caused to pass over the slant sheet-separator plate 22, and then the roller 25 is disposed on the paper sheets accommodated in the tray 20. Thus, the outer circumferential surface of the roller 25 is brought into pressing contact with the accommodated paper sheets.

As described above, the sheet supply arm 26 is biased downwardly by its own weight and the biasing spring (not shown). When the sheet supply roller 25 is rotated with the arm 26 being thus downwardly biased, a large pressing force is generated between the paper sheets and the circumferential surface of the roller 25. This pressing force generated by rotation of the roller 25 is a force acing on the paper sheets in a direction pressing the paper sheets down against the sheet supply tray 20, which force is generated by a reaction force opposing the movement of the paper sheets in a feed direction by the friction acting between the outer circumferential surface of the roller 25 and the paper sheets. The force generated by the reaction forces the arm 26 to be pivoted about the shaft 55 in clockwise direction as seen in FIG. 2, whereby the paper sheets are forced downwardly against the tray 20. Since the roller 25 is rotated while the pressing force acts on the paper sheets, a force for moving the paper sheets in the feed direction is enhanced. The pressing force generated by the rotation of the roller 25 is incomparatively larger than a pressing force that is generated by the own weight of the arm 26 and the biasing force of the biasing spring without the rotation of the roller 26. Therefore, in the following description, the basing force of the biasing spring is ignored.

The above-described rotation force, i.e., the pressing force, which is generated while the rotated sheet supply roller 25 is held in contact with its outer circumferential surface with the paper sheets accommodated in the sheet supply tray 20, tends to vary depending upon an amount of the paper sheets remaining or stacked in the tray 20, in other words, depending upon the inclination angle è (see FIG. 4) of the sheet supply arm 26 that is changed with change in the stacked amount of the paper sheets. This is a relationship that was found as a result of an intensive study made for analyzing actually measured data of the inclination angle è and the pressing force. For example, when the tray 20 is fully loaded with the paper sheets as shown in view (a) of FIG. 4, the inclination angle è is relative small. In this stage, the pressing force acting on a point of contact of the outer circumferential surface of the sheet supply roller 25 and the paper sheet S is relatively small. On the other hand, when the stacked amount of the paper sheets is reduced as shown in views (b), (c) of FIG. 4, the inclination angle è is gradually increased. The pressing force acting on the point of contact of the outer circumferential surface of the roller 25 and the paper sheet S tends to be increased as the inclination angle è is increased.

When the sheet supply roller 25 is rotated with the roller 25 being held in contact at its outer circumferential surface with the paper sheets, the pressing force is generated between the surface of the roller 25 and the paper sheets, as descried above. Consequently, the friction is generated between the surface of the roller 25 and the paper sheets, so that at least the uppermost one of the paper sheets is moved toward the slant sheet-separator plate 22 owing to the generated friction. Since the friction is variable depending upon the inclination angle è of the sheet supply arm 26, as described above, the friction generated between the surface of the roller 25 and the paper sheets is relative small while the inclination angle è is small. Thus, the load acting on the sheet supply motor 81 is relatively small while the inclination angle è is small. On the other hand, as the inclination angle è is increased, the load acting on the motor 81 is increased as a result of increase in the friction generated between the surface of the roller 25 and the paper sheets.

The paper sheets moved to the slant sheet-separator plate 22 come into contact at their leading ends with the plate 22, whereby only the uppermost paper sheet is separated from the other paper sheets, so as to be guided upwardly and then introduced into the sheet feed path 23. When the uppermost paper sheet is fed by the sheet supply roller 25, even if the paper sheet below the uppermost paper sheet is moved together with the uppermost paper sheet, for example, due to effect of the friction or static electricity, the paper sheet in question is brought into contact with the plate 22, whereby the multi-feed is restrained.

On the other hand, when no paper sheet remains in the sheet supply tray 20, the sheer supply roller 25 is brought into pressing contact at its outer circumferential surface with the cork piece 19. Although the sheet supply motor 81 is controlled to be rotated even in this state, the roller 25 is held stationary due to the large friction generated between the outer circumferential surface of the roller 25 and the cork piece 19. In this instance, the load acting on the rotated sheet supply motor 81 is increased, and the load current of the motor 81 is increased by a feedback control that is described below. When the load current of the sheet supply motor 81 is increased to a predetermined overloaded electric current value (Ia), the motor 81 is immediately stopped.

The sheet feed path 23 is defined, except in some portions thereof such as a portion in which the image recording portion 24 is located, by and between an outside guide surface and an inside guide surface that are opposed to each other with a predetermined distance between. For example, in a portion of the sheet feed path 23 that is located in a rear portion of the multifunction device 1, the outside guide surface is formed integrally with a frame of the main body of the multifunction device 1 while the inside guide surface is a guide member 54 attached to the frame of the main body. Guide rollers 29 are disposed in certain portions of the feed path 23 such as curved portions. Each of the guide rollers 29 is disposed to be freely rotatable about its axis that is parallel with a width direction of the feed path 23 (i.e., a direction perpendicular to the drawing sheet of FIG. 2). The axis of each guide roller 29 is located in one of opposite sides of the outside or inside guide surface that is remote from the feed path 23 such that the outer circumferential surface of each guide roller 29 slightly projects from the guide surface into the feed path 23 or faces the feed path 23. The provision of the guide rollers 29 makes it possible to smoothly feed the paper sheet that tends to be brought into contact with the outside or inside guide surface in the curved portions of the feed path 23.

The image recording portion 24 includes the scanning carriage 31 which carries the recording head 30 and which is reciprocatable in a main scanning direction (that is perpendicular to the drawing sheet of FIG. 2). The recording head 30 is arranged to receive various color inks such as cyan (C), magenta (M), yellow (Y) and black (Bk) that are supplied from respective ink tanks 32 (see FIG. 3) through respective ink tubes 33, and is operable to eject the inks in the form of ink droplets through a multiplicity of nozzles formed in its lower end surface. With reciprocating motion of the carriage 31 in the main scanning direction, the recording head 30 is scanned relative to the paper sheet, whereby an image is recorded on the paper sheet that is being moved on the platen 34. Although the printer portion 2 is provided by an inkjet printer in the present embodiment, the printer portion 2 may be, for example, provided by a laser printer (in which toner particles are caused to adhere to an electrostatic latent image that is formed on a photosensitive body by using a laser light, and the toner particles are transferred onto the paper sheet), an analog-electrophotography-type image forming device, or a thermal-type image forming device (so-called "thermal printer) in which a printing operation is performed by discolorating a photosensitive paper sheet through a heat treatment.

As shown in FIGS. 2 and 3, a pair of guide rails 35, 36 are disposed above the portion of the sheet feed path 23 in which the image recording portion 24 is disposed. The guide rails 35, 36 are spaced apart from each other in a feed direction of the paper sheet, and extend in a direction parallel to the width direction of the feed path 23. The carriage 31 straddles the guide rails 35, 36, so as to be slidable on the guide rails 35, 36 in the width direction of the feed path 23. The guide rail 35, which is an upstream-side one of the guide rails 35, 36 as viewed in the feed direction of the paper sheet, is provided by a generally flat plate having a length (as measured in the width direction of the feed path 23) that is larger than a scanning width of the scanning carriage 31. The carriage 31 is freely slidably held at its upstream end portion by an upper surface of the guide rail 35.

The guide rail 36, which is a downstream-side one of the guide rails 35, 36 as viewed in the sheet feed direction, is provided by a generally flat plate having a length (as measured in the width direction of the feed path 23) that is substantially equal to the upstream-side guide rail 35. The carriage 31 is freely slidably held at its downstream end portion by the upper surface of the guide rail 36. The guide rail 36 has an upstream end portion 37 (as viewed in the sheet feed direction) that is bent by substantially a right angle so as to project upwardly. The carriage 31 is provided with an engaging member that is arranged to grip the upstream end portion 37 of the downstream-side guide rail 36 so as to be held in engagement with the end portion 37. Owing to the engagement of the engaging member with the end portion 37 of the guide rail 36, the carriage 31 slidable held on the guide rails 35, 36 can be reciprocated in the width direction of the sheet feed path 23, without risk its displacement in the sheet feed direction. The engaging member may be replaced by a pair of rollers that cooperate with each other to grip the end portion 37 of the guide rail 36. Further, in portions of the carriage 31 that are slidably held in contact with the upper surfaces of the guide rails 35, 36, there are suitably provided sliding members for reducing a friction generated between the carriage 31 and the guide rails 35, 36.

A belt drive mechanism 38 is disposed above the upper surface of the guide rail 36 (see FIG. 3). The belt drive mechanism 38 includes drive and driven pulleys 39, 40 that are disposed in respective end portions of the drive mechanism 38 that are opposite to each other in the width direction of the sheet feed path 23, and a timing belt 42 that is wound on the pulleys 39, 40. The timing belt 42 is provided by an endless belt having evenly spaced teeth formed in its inside surface. A CR (carriage) motor (not shown) is connected to a shaft of the drive pulley 39, so that a drive force is transmitted from the CR motor to the drive pulley 39. The timing belt is circulated by rotation of the drive pulley 39. It is noted that the timing belt 42 does not have to be necessarily provided by the endless belt, by may be a non-endless belt that is connected at its opposite end portions to the carriage 31.

The carriage 31, which is fixed to the timing belt 41, is reciprocated on the guide rails 35, 36 by circular motion of the timing belt 41, with the engaging member provided in the carriage 31 being engaged with the end portion 37 of the guide rail 36. The recording head 30 mounted on the carriage 31 is reciprocatable together with the carriage 31 in the width direction of the sheet feed path 23 as the main scanning direction. An encoder strip 42 of a linear encoder device is provided in the guide rail 35, and extends along the end portion 37 of the guide rail 36. The encoder strip 42 cooperates with a photo interrupter (not shown) to constitute the linear encoder device. The photo interrupter is fixed to the carriage 31, and is arranged to sense a plurality of sensible portions that are arranged in the encoder strip 42, so that the reciprocating motion of the carriage 31 can be detected by the linear encoder device. The reciprocating motion of the carriage 31 is controlled based on a signal which is supplied from the linear encoder device and which represents the detected reciprocating motion of the carriage 31.

As shown in FIG. 2, the platen 34 is disposed on the lower side of the sheet feed path 23 and is opposed to the recording head 30. The platen 34 extends over a central portion of a stroke range of the reciprocating motion of the carriage 31, i.e., a portion of the stroke range through which the paper sheet passes. The platen 34 has a width (as measured in the width direction of the feed path 23) that is sufficiently larger than a width of a feedable maximum-sized paper sheet, so that widthwise opposite ends of each paper sheet always pass over the platen 34.

As shown in FIG. 3, a maintenance mechanism 43 and a flushing portion 44 are disposed outside an image-recording operation area within which the recording operation is performed by the recording head 30, namely, disposed in opposite sides of the platen 34 in which each paper sheet does not pass. The maintenance mechanism 43 is arranged to suck ink from the nozzles of the recording head 30 so as to remove air bubbles and foreign matters that are contained in the ink. The maintenance mechanism 43 includes a cap 45 that is movable by a movement mechanism toward and away from a nozzle opening surface (i.e., lower end surface) of the recording head 30 so as to cover and uncover the nozzle opening surface of the head 30. When the air bubbles and the foreign matters are to be removed from the nozzles, the carriage 31 is moved to position the recording head 30 right above the cap 45, and then cap 45 is moved upwardly to be brought into close contact with the nozzle opening surface of the head 30. While the nozzle opening surface of the head 30 is tightly closed by the cap 45, the ink is sucked from the nozzles by activation of a suction pump that is connected to the cap 45. Since the construction and operation of the maintenance mechanism 43 are well known, redundant description thereof is not provided herein.

The flushing portion 44 is disposed outside the image-recording operation area, specifically, in one of the opposite sides of the platen 34 that is remote from the maintenance mechanism 43. The flushing portion 44 is operated, prior to or during the recording operation, to receive the ink that is compulsorily ejected through each of the nozzles of the recording head 30. This compulsory ejection is called "flushing". Owing to the operations of the maintenance mechanism 43 and the flushing portion 44 for removing the air bubble and mixed color ink from the recording head 30, a condition required for a normal ink ejection can be constantly maintained in the recording head 30.

As shown in FIG. 3, the ink tanks 32 are accommodated in respective accommodating portions of a tank accommodator 46 disposed in a box that is located in a front right side of the printer proton 2. The ink tanks 32 consist of four ink tanks 32C, 32M, 32Y, 32K storing respective color inks, i.e., cyan (C), magenta (M), yellow (Y) and black (Bk) inks. Each of the ink tanks 32C, 32M, 32Y, 32K is provided by a cartridge-type box that is made of resin and filled with the correspond color ink. The ink tanks 32 are disposed independently of the carriage 31 carrying the recording head 30. Each color ink is supplied from the corresponding ink tank 32 to the recording head 30 through the corresponding ink tube 33.

Each color ink is supplied from a corresponding one of the ink tanks 32C, 32M, 32Y, 32K accommodated in the tank accommodator 46 to the recording head 30 through a corresponding one of the ink tubes 33C, 33M, 33Y, 33K that are dependent from each other. Each of the ink tubes 33 is provided by a tube made of a flexible material such synthetic resin, so as to be flexed according to the reciprocating motion of the carriage 31. Each ink tube 33 is connected at one of its opposite opening ends to a corresponding one of connecting portions that are provided in the respective accommodating portions of the tank accommodator 46. The ink tube 33C is connected to the ink tank 32C, and serves to supply the cyan (C) ink. Similarly, the ink tubes 33M, 33Y, 33K are connected to the ink tanks 32M, 32Y, 32K, respectively, and serve to supply the magenta (M), yellow (Y) and black (Bk) inks, respectively.

Each of the ink tubes 33 coming from the ink tank accommodator 46 (located in the front right side of the printer portion 2) includes a tank-side portion that is arranged to extend to a central portion of the multifunction device 1 in the width direction of the multifunction device 1, and a carriage-side portion that is arranged to extend to the carriage 31 from the central portion of the device. The tank-side portion of each ink tube 33 is fixed to a suitable portion of the device 1 such as the frame of the main body. Meanwhile, the carriage-side portion of each ink tube 33 is not fixed to the frame of the main body so that the carriage-side portion of each ink tube 33 has a posture or shape that is variable as a result of the reciprocating motion of the carriage 33. Described specifically, during movement of the carriage 31 in the leftward direction as seen in FIG. 3, a radius defined by the U-shaped curved carriage-side portion of each ink tube 33 is reduced as the carriage 31 is moved leftward. During movement of the carriage 31 in the rightward direction as seen in FIG. 3, the radius defined by the U-shaped curved carriage-side portion of each ink tube 33 is increased as the carriage 31 is moved rightward.

As shown in FIG. 2, on the upstream side of the image recording portion 24, there are disposed a pair of rollers that are opposed to each other. The pair of rollers are provided by the above-described sheet feed roller 47 and a pinch roller 48, and cooperate with each other to grip the paper sheet that is fed along the sheet feed path 23, so as to pass over the platen 34. On the downstream side of the image recording operation 24, there are disposed a pair of rollers that are opposed to each other. The pair of rollers are provided by a sheet discharge roller 49 and a rowel 50 (small spiked roller), and cooperate with each other to grip the paper sheet so as to further feed the paper sheet on which an image has been formed. The sheet feed roller 47 and the sheet discharge roller 49 are drive rollers to each of which a drive force is transmitted from a motor (not shown). The rollers 47, 49 are rotated in synchronization with each other, and intermittently after each line feed. The encoder disk 51 provided in the sheet feed roller 47 cooperates with the photo interrupter (arranged to a plurality of sensible portions arranged in the encoder disk 51) to constitute a rotary encoder device. The rotary motion of each of the rollers 47, 49 is controlled based on a signal which is supplied from the rotary encoder device and which represents the detected rotary motion of each of the rollers 47, 49.

As shown in FIG. 2, a register sensor 56 is disposed on an upstream side of the above-described pair of rollers 47, 48, for detecting the leading end of the paper sheet that is fed along the sheet feed path 23. This register sensor 56 is provided by an optical sensor, and includes a detector element 57 and a photo interrupter 58. The detector element 57 is arranged to normally protrude upwardly from a wall defining a lower end of the sheet feed path 23, and to be pivoted in a direction away from the feed path 23 when the paper sheet comes into contact with the detector element 57. The pivot motion of the detector element 57 is detected by the photo interrupter 58. The detector element 57 is integrally formed with a shield portion that is detected by the photo interrupter 58, and is disposed pivotably about a shaft. The detector element 57 is biased by a biaser such as spring (not shown) so as to normally protrude in the feed path 23. Thus, as long as no external force is applied to the detector element 57, the detector element 57 constantly protrudes in the feed path 23, causing the shield portion to be positioned between a light emitting portion and a light receiving portion of the photo interrupter 58, so that a light transmission of the photo interrupter 58 is blocked, whereby the register sensor 56 is held OFF. When the fed paper sheet is brought into contact at its leading end with the detector element 57, the detector element 57 is pivoted for releasing the blockage of the light transmission by the shield portion, whereby the register sensor 56 is turned ON. A signal outputted by the register sensor 56 is supplied to a main controller 60 that is described below.

After only one paper sheet is separated from the sheet supply tray 20 by the sheet supply roller 25, the sheet feed roller 47 is rotated in the reverse direction in a period from a moment at which the leading end of the paper sheet is detected by the register sensor 56, to another moment at which a predetermined length of time Ät elapses from the detection of the leading end of the paper sheet (see FIG. 9). Thus, the leading end of the paper sheet fed along the feed path 23 is positioned in a nip position between the sheet feed roller 47 and the pinch roller 48. That is, a registering procedure is performed on the fed paper sheet. When the predetermined length of time Ät elapses (at a point of time t4 in FIG. 9), it is determined that the registering procedure is completed, and the sheet feed roller 47 is rotated in the forward direction whereby the paper sheet (having being subjected to the registering procedure) is moved to the platen 34.

The pinch roller 48 is biased by a spring or the like to be forced against the sheet feed roller 47 by a predetermined pressing force, and is arranged to be freely rotatable. When the paper sheet enters between the feed roller 47 and the pinch roller 48, the pinch roller 48 is displaced away from the feed roller 47 by a small distance corresponding to a thickness of the paper sheet, so as to cooperate with the feed roller 47 to grip the paper sheet. Owing to this arrangement, the rotational force of the feed roller 47 is reliably transmitted to the paper sheet. A cooperative relationship between the rowel 50 and the sheet discharge roller 49 is similar to that between the pinch roller 48 and the sheet feed roller 47. However, the rowel 50, which comes into contact with the paper sheet having an image already formed thereon, is a roller having a plurality of radially-outwardly extending sharp projections, for avoiding deterioration or damage of the image formed on the paper sheet.

The paper sheet gripped between the sheet feed roller 47 and the pinch roller 48 is intermittently fed on the platen 34, with an amount of each intermittent motion of the paper sheet corresponding to an amount of line feed that is dependent on a selected recording mode. The recording head 30 is scanned after each line feed, whereby an image forming operation is carried out from a leading end portion of the paper sheet toward a trailing end portion of the paper sheet. The leading end portion of the paper sheet, after being subjected to the image forming operation, is gripped between the sheet discharge roller 49 and the rowel 50. That is, with the leading end portion being gripped between the sheet discharge roller 49 and the rowel 50, and with the trailing end portion being gripped between the sheet feed roller 47 and the pinch roller 48, the paper sheet is fed by the amount of line feed in each intermittent motion, and the image forming operation is carried out by the recording head 30 after each line feed. When the paper sheet is further fed in the feed direction, the trailing end of the paper sheet passes between the sheet feed roller 47 and the pinch roller 48, whereby the grip of the paper sheet by the rollers 47, 48 is released. That is, with the paper sheet being gripped between the sheet discharge roller 49 and the rowel 50, the paper sheet is fed by the amount of line feed in each intermittent motion, and the image forming operation is carried out by the recording head 30 after each line feed. After the image forming operation has been completed for the entirety of a predetermined image forming area, the sheet discharge roller 49 is continuously rotated. The paper sheet gripped between the sheet discharge roller 49 and the rowel 50 is eventually discharged to the sheet exit tray 21.

As shown in FIG. 3, a controller board 52 is disposed in a front portion of the multifunction device 1. A flat cable 53 is provided to electrically connect the controller board 52 and a controller board (not shown) of the recording head 30, so that various electric signals such a signal indicative of data of the image to be recorded are transmitted from the controller board 52 to the recording head 30. The flat cable 53 has a thin strip shape, and includes conductive bodies which transmit therethrough the electric signals and which are insulatedly covered by a synthetic-resin film. The flat cable 53 extends from the carriage 31 in a direction substantially parallel to the reciprocating motion of the carriage 31. The flat cable 53 includes a generally U-shaped portion that is bent in the vertical direction. The U-shaped portion of the cable 53 is not connected to other member, so that its posture is changeable by the reciprocating motion of the carriage 31.

(Main Controller)

Figure 5:
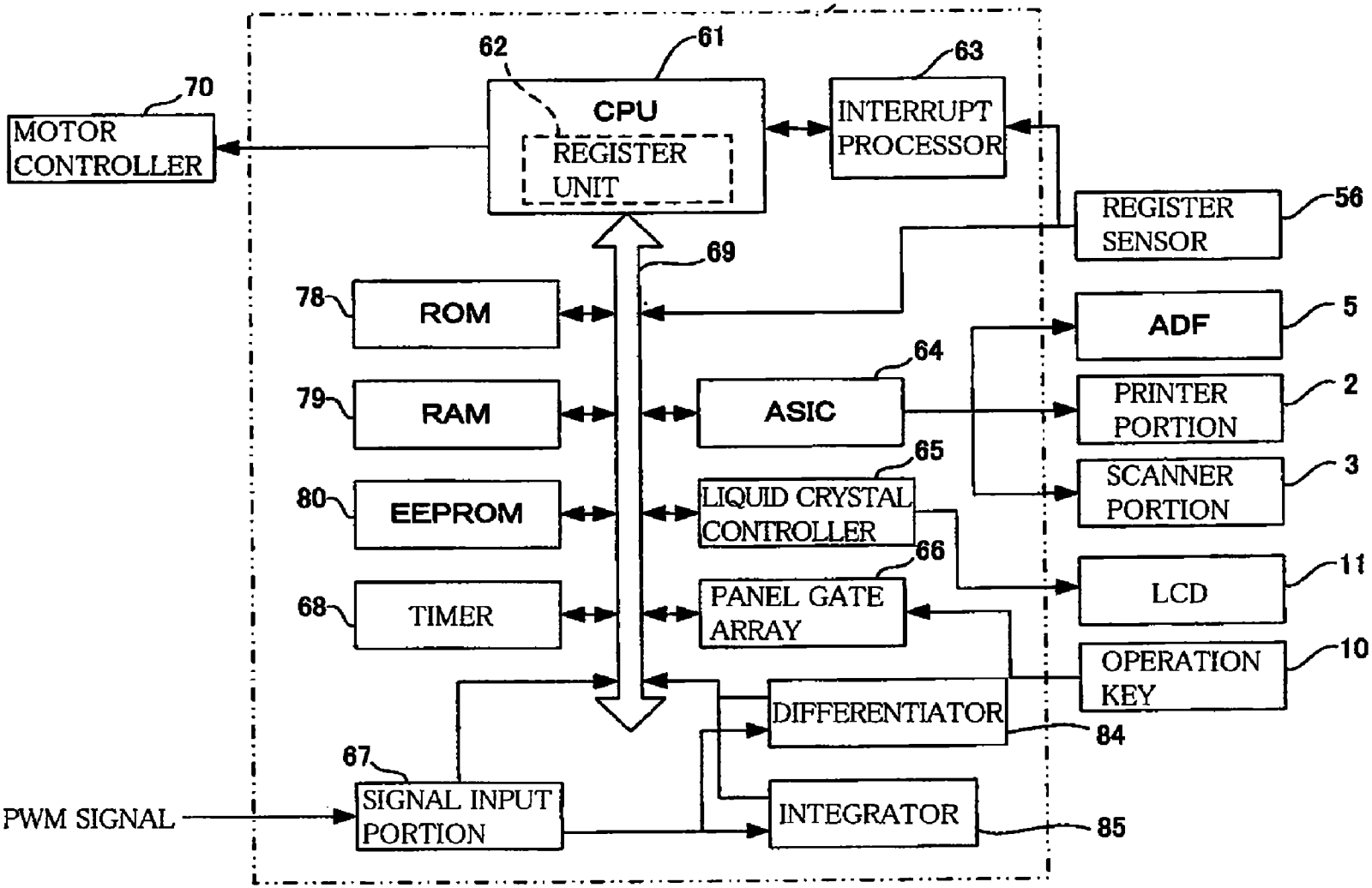
FIG. 5 is a block diagram showing a general construction of a main controller 60.

Referring next to a block diagram of FIG. 5, there will be described the main controller 60 that control various motions of the multifunction device 1. The main controller 60 is provided by the controller board 52 (see FIG. 3) incorporating a microcomputer that is constituted principally by a CPU (Central Processing Unit) 61, a ROM (Read Only Memory) 78, a RAM (Random Access Memory) 79 and a EEPROM (Electrically Erasable and Programmable ROM) 80. Described specifically, the controller 60 includes, in addition to the CPU, 61, ROM 78, RAM 79 and EEPROM 80, other control devices such as an ASIC (Application Specific Integrated Circuit) 64, a liquid crystal controller 65, a panel gate array (panel GA) 66, a signal input portion 67, a timer 68, a differentiator 84 and an integrator 85. These control devices are connected to each other via s bus 69, so as to be communicable therebetween. The main controller 60 is provided with an interrupt processor 63 for supplying an interruption suspension signal to the CPU 61. To the bus 69, there are connected a NCU (Network Control Unit) and a MODEM (not shown) for enabling the device 1 to perform the facsimile function. The bus 69 includes an address bus portion, a data bus portion and a control-signal wire portion.

The ROM 78 stores therein, for example, programs for controlling various motions of the multifunction device 1. Meanwhile, the RAM 79 is used as a working or storage area for temporarily storing various data, based on which the programs are executed by the CPU 61. The EEPROM 80 is a rewritable non-volatile memory, and stores pattern determination data taking the form of a data table (see Table 1). Pattern values shown in Table 1 are predetermined as shown in Table 2, and also take the form of a data table that is stored in the EEPROM 80. In the present embodiment, the EEPROM 80 storing the pattern determination data serves a type-determination reference data storage, a finality-determination reference data storage, and a remaining-amount determination reference data storage that are recited in claims appended hereto.

TABLE 1

| Pattern Values | | | | Determination Contents | | | |
|---|---|---|---|---|---|---|---|
| Tb | Tha | Thb | Tr | | | | |
| 1 | 2 | — | — | sheet absent | — | — | Roller Normal |
| 1 | 1 | — | — | sheet | — | — | roller- |

TABLE 1-continued

| Pattern Values | | | | Determination Contents | | | |
|---|---|---|---|---|---|---|---|
| Tb | Tha | Thb | Tr | | | | |
| | | | | absent | | | check needed |
| 0 | 0 | 1 | 0 | sheet present | glossy paper | Sufficient amount | — |
| 0 | 0 | 1 | 1 | sheet present | glossy paper | Small amount | — |
| 0 | 0 | 3 | 1 | sheet present | glossy paper | Final sheet | — |
| 0 | 0 | 0 | 0 | sheet present | standard paper | Sufficient amount | — |
| 0 | 0 | 0 | 1 | sheet present | standard paper | Small amount | — |
| 0 | 0 | 2 | 1 | sheet present | standard paper | Final sheet | — |

TABLE 2

| Stage | Determination Condition | Pattern Values |
|---|---|---|
| Tb | I ≧ Ia | 1 |
| | I < Ia | 0 |
| Tha | ∫I(t)dt ≧ Ia (t2 − t1) and dI(t)/dt ≧ K | 1 |
| | ∫I(t)dt ≧ Ia (t2 − t1) and dI(t)/dt < K | 2 |
| | ∫I(t)dt < Ia (t2 − t1) | 0 |
| Thb | I ≧ Ib | 3 |
| | I ≧ Ic | 2 |
| | I ≧ Id | 1 |
| | I < Id | 0 |
| Tr | I ≧ Ie | 1 |
| | I < Ie | 0 |

The CPU 61 is arranged to control all controllable devices and portions such as the controller devices (constituting the CPU 61), the motor controller 70 (serving as a controller for adjusting a variable based on which the sheet supply motor 81 is controlled), the ADF 5, the printer portion 2 and the scanner portion 3. The CPU 61 includes various determiners as described below. The CPU 61 incorporates a universal register unit (hereinafter simply referred to as "register unit") 62 including a plurality of registers storing respective various predetermined values (see Table 3). The plurality of registers include a velocity register storing a predetermined velocity $V_0$ of the sheet supply motor 81, a limit set register storing a maximum current value Imax based on which it is determined whether the sheet supply motor 81 is to be emergently stopped, and first through seventh threshold-value registers storing respective threshold values that are used in various determinations made by the CPU 61 in accordance with a routine represented by flow chart as described below. The threshold values will be described later in detail.

TABLE 3

| Registers | Stored Values |
|---|---|
| Velocity Register | V0 |
| Limit Setter Register | Imax |
| 1st threshold Value Register | Ia |
| 2nd threshold Value Register | Ib |
| 3rd threshold Value Register | Ic |
| 4th threshold Value Register | Id |
| 5th threshold Value Register | Ie |

TABLE 3-continued

| Registers | Stored Values |
|---|---|
| 6th threshold Value Register | Ia (t2 – t1) |
| 7th threshold Value Register | K |

The ADF (automatic document feeder) 5, printer portion 2 and scanner portion 3 are connected to the ASIC 64 that generates control signals based on commands supplied thereto from the CPU 61. The generated control signals are supplied to the ADF 5, printer portion 2 and scanner portion 3, for thereby controlling the ADF 5, printer portion 2 and scanner portion 3. However, the above-described devices and portions may be controlled based on the programs that are executed by the CPU 61, without using a hard logic circuit such as the ASIC 64.

The LCD 11 is connected to the liquid crystal controller 65, so as to be controlled by the liquid crystal controller 65. The LCD 11 displays, under control of the liquid crystal controller 65, information related to the operation of the sheet feeder 18 and error occurred in the sheet feeder 18. As the information displayed by the LCD 11, there are information related to the sheet feed error such as paper jamming occurred in the sheet feeder 18 and slip motion of the sheet supply roller 25, an amount of the paper sheets remaining in the sheet supply tray 20, and a condition of the sheet supply roller 25.

The panel gate array 66 serves an interface for allowing inputs of various commands through the operation keys 10 (such as start button and stop button) disposed in the operator's control panel 6 of the multifunction device 1. The panel gate array 66 also serves to control the operation keys 10. When each of the operation keys 10 is pressed, the panel gate array 66 detects pressing of the key and then outputs a code signal indicative of a key code that is assigned to the pressed key. When the CPU 61 receives the code signal supplied from the panel gate array 66, the CPU 61 carries out a control procedure according to a predetermined procedure table. This procedure table is a table representative of relationship between the key code and the control procedure, and is stored, for example, in the ROM 78.

The interrupt processor 63 is operated, in response to input of an interruption signal, to temporarily suspend a normal procedure executed by the CPU 61 and then execute a predetermined procedure when an interruption condition is satisfied. Specifically described, the interrupt processor 63 outputs the interruption suspension signal, when the predetermined length of time Δt elapses from reception of an ON signal (corresponding to an interruption signal) indicative of detection of the paper sheet by the register sensor 56 (see FIG. 9). The interruption suspension signal is for causing the CPU 61 to suspend driving of the sheet supply motor 81. Thus, upon reception of the interruption suspension signal, the CPU 61 supplies a motor stop signal to the motor controller 70, for stopping the sheet supply motor 81.

The timer 68 is arranged count a length of time from a moment at which the motor controller 70 receives a motor drive signal for driving the sheet supply motor 81, to another moment at which the motor controller 70 receives the above-described motor stop signal. When the motor controller 70 receives the motor stop signal, the timer 68 is reset by the CPU 61. It is noted that the above-described length of time may be counted by a software using a timer program, rather than by the timer 68.

The signal input portion 67 is an input interface for allowing input of a PWM signal outputted from a PWM-signal generator circuit 75. In the signal input portion 67, the inputted PWM signal is converted into an electric current signal corresponding to the inputted PWM signal. The electric current signal is a motor electric current (corresponding to the above-described variable) that is supplied to the sheet supply motor 81. The motor electric current (into which the PWM signal is converted in the signal input portion 67) is monitored by the CPU 61 serving as a monitor. In the present embodiment, the motor electric current flowing through the sheet supply motor 81 is monitored. However, the present invention is applicable also to an arrangement in which the PWM signal per se or a control signal (electric voltage signal) applied for driving the sheet supply motor 81 is monitored.

The differentiator 84 includes a circuit in which a signal waveform of the motor electric current (into which the PWM signal is converted in the signal input portion 67) is converted into a signal waveform as a derivative of the signal waveform with respect to time. In general, the differentiator 84 is provided by a known circuit in which its input terminal is connected to opposite ends of a series circuit of a condenser and a resistance while its output terminal is connected to opposite ends of the resistance. Meanwhile, the integrator 85 includes a circuit in which the signal waveform of the motor electric current (into which the PWM signal is converted in the signal input portion 67) is converted into a signal waveform as an integral of the signal waveform with respect to time. In general, the integrator 85 is provided by a known circuit in which its input terminal is connected to opposite ends of a series circuit of a condenser and a resistance while its output terminal is connected to opposite ends of the condenser. In the present embodiment, the motor electric current I(t) during a stage Tha is differentiated by the differentiator 84 and is integrated by the integrator 85. It is noted that the stage Tha corresponds to a period from a moment at which a length of time t1 elapses (from initiation of driving of the sheet supply motor 81) to another moment at which a length of time t2 elapses (from the initiation of driving of the sheet supply motor 81).

(Motor Controller)

Figure 6:
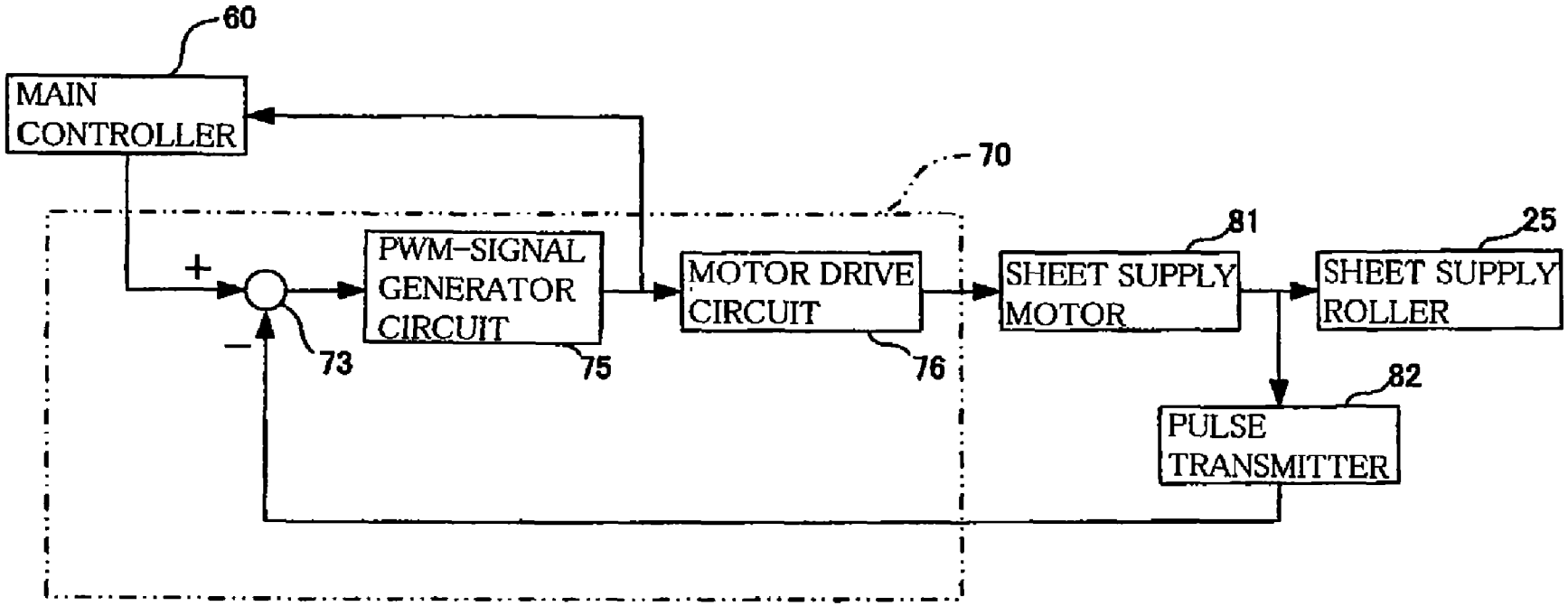
FIG. 6 is a block diagram showing a general construction of a motor controller 70.

As shown in FIG. 6, the motor controller 70 includes, in addition to the above-described PWM-signal generator circuit 75, a comparator circuit 73 and a motor driver circuit 76, and is constituted by a feedback control circuit for controlling drive of the sheet supply motor 81 on the basis of the pulse signal supplied from the pulse generator 82. The motor controller 70 is typically provided by a motor driver LSI or a motor driver IC incorporating the above-descried circuits in the form of integral circuits.

The comparator circuit 73 is a circuit for comparing two signals inputted thereto and outputting a deviation between the two signals. As shown in FIG. 6, the comparator circuit 73 is arranged to receive the two signals, one of which is the motor drive signal for rotating the sheet supply motor 81 at the predetermined velocity $V_0$, and the other of which is the pulse signal (velocity signal). The motor drive signal is a signal supplied from the main controller 60 while the pulse signal is a signal supplied from the pulse transmitter 82. Thus, in the present embodiment, a velocity deviation ±ΔV between the motor drive signal and the pulse signal is detected in the comparator circuit 73. The detected velocity deviation ±ΔV is supplied to the PWM-signal generator circuit 75.

The PWM-signal generator circuit 75 generates the PWM signal (corresponding to the variable having been adjusted). In generation of the PWM signal, the velocity deviation ±ΔV as well as the predetermined velocity $V_0$ is taken into account. The motor drive circuit 76 receives the generated PWM signal supplied from the PWM-signal generator circuit 75, and generates a control signal (electric voltage signal) for controlling drive of the sheet supply motor 81, for thereby rotating the sheet supply roller 25 at a predetermined velocity.

Referring next to FIGS. 9-13, there will be described a chronological change of the motor electric current I that flows through the sheet supply motor 81 while the paper sheet accommodated in the sheet supply tray 20 is fed by rotation of the sheet supply roller 25 as described above.

Figure 9A:
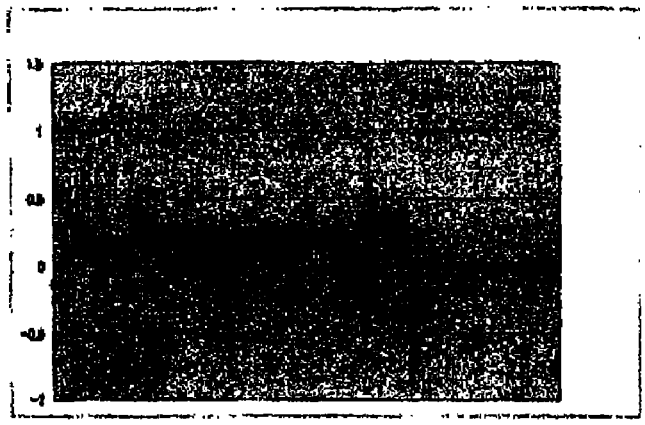
FIGS. 9A and 9B are views for showing a waveform ($I_1(t)$) representing, by way of example, a chronological change of an electric current I supplied to an electric motor when a sufficient amount of standard papers remain in a sheet supply tray 20.
Figure 9B:
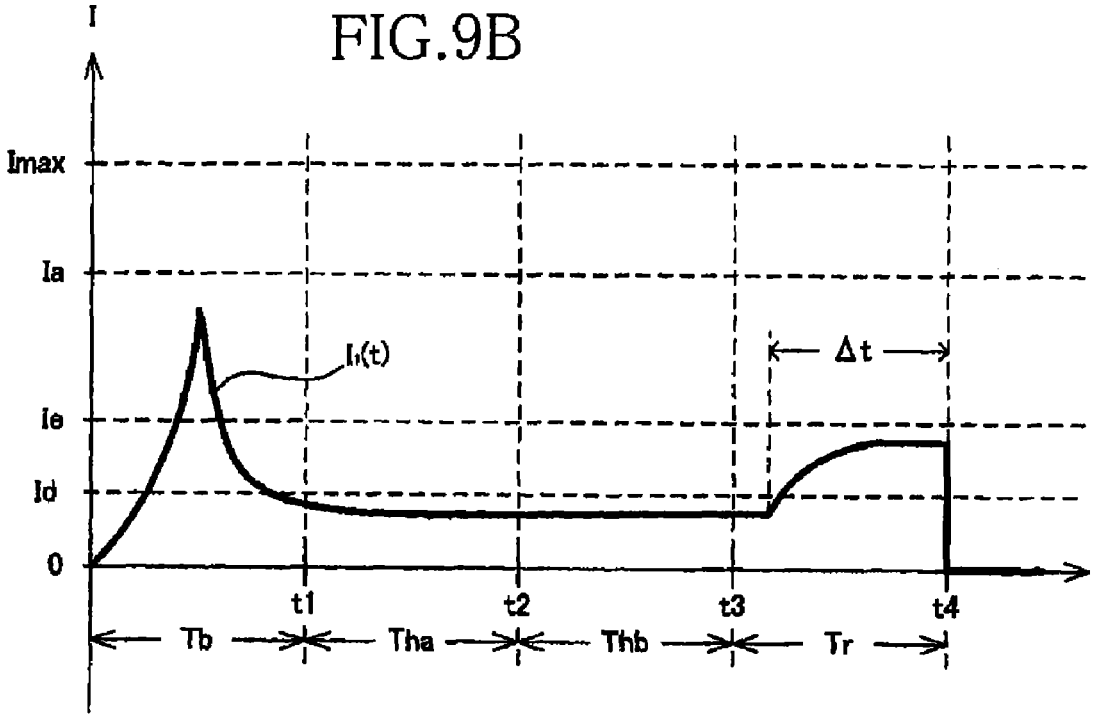

FIGS. 9A and 9B are views for showing a waveform $I_1(t)$ representing the chronological change of the motor electric current I supplied to the sheet supply motor 81 when a standard paper as the paper sheet is normally fed with the sheet supply tray 20 being fully loaded with standard papers. FIG. 9A shows an actually measured data of the motor electric current I, while FIG. 9B schematically shows the measured data, for easier understanding. In a graph of each of FIGS. 9A and 9B, the ordinate axis indicates the motor electric current I while the abscissa axis indicates time t. As is apparent from the waveform $I_1(t)$ shown in FIGS. 9A and 9B, the motor electric current I flowing through the sheet supply motor 81 is rapidly increased immediately after initiation of supply of the paper sheet, since a sufficiently large torque is required for overcoming a static torque of the motor 81. However, before reaching an over-loaded electric current value Ia, the motor electric current I is reduced so as to be converged to a certain value before a predetermined length of time T1 elapses from initiation of supply of the paper sheet (in a stage Tb). The converged state is temporarily kept until a predetermined length of time T3 elapses (in stages Tha, Thb). Thereafter, since the fed paper sheet is subjected to the registering procedure, the motor electric current I is increased, as a result of slight increase in the load acting on the sheet supply motor 81, at a predetermined timing after a predetermined length of time t3 elapses (in a stage Tr). Then, the motor electric current I is abruptly reduced to zero at a point of time t4 at which the predetermined length of time Δt elapses from initiation of the registering procedure, since the sheet supply motor 81 is stopped at the point of time t4. The over-loaded electric current value Ia is a value set in the first threshold value register (seed Table 3). The over-loaded electric current value Ia is predetermined such that the motor electric current I (flowing through the sheet supply motor 81) does not reach the value Ia as long as the paper sheet is normally fed and such that the motor electric current I reaches the value Ia when the sheet supply motor 81 is driven with no paper sheet, as described below.

The above-described times t1, t2, t3, t4 are time parameters that are determined suitably depending upon, for example, specifications of components constituting the sheet supply motor 81 and the sheet feeder 18. These time parameters are determined suitably based on actually measured data of the motor electric current I. The length of time t3 is an expected length of time from initiation of driving of the sheet supply motor 81 to initiation of the registering procedure, and may be equal to, for example, a previously measured length of time that is required to cause the paper sheet to reach the sheet feed roller 47. The point of time t4 is a point of time at which the predetermine length of time Δt elapses from initiation of the registering procedure, and may be equal to, for example, a point of time at which the predetermine length of time Δt elapses from turning ON of the output signal of the register sensor 56. The length of time t1 is a length of time that is required to cause the motor electric current I to be converged to a constant value. This length of time t1 is obtained by calculation made based on actually measured data. In the present embodiment, the length of time t2 is an intermediate value between the length of time t1 and the length of time t3.

Figure 10A:
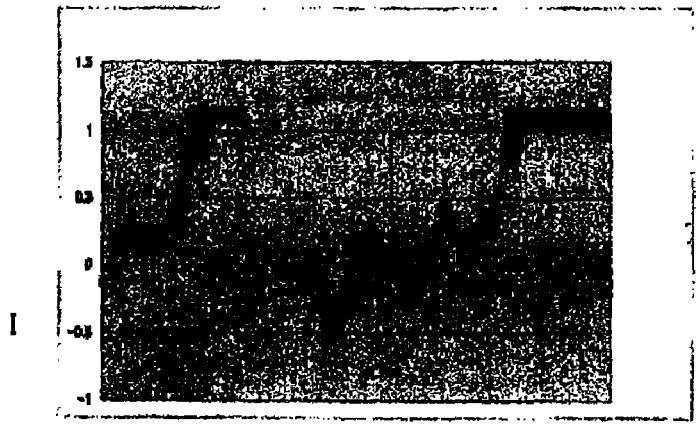
FIGS. 10A and 10B are views for showing a waveform ($I_2(t)$) representing, by way of example, a chronological change of an electric current I supplied to the electric motor when no media sheet remains in the sheet supply tray 20.
Figure 10B:
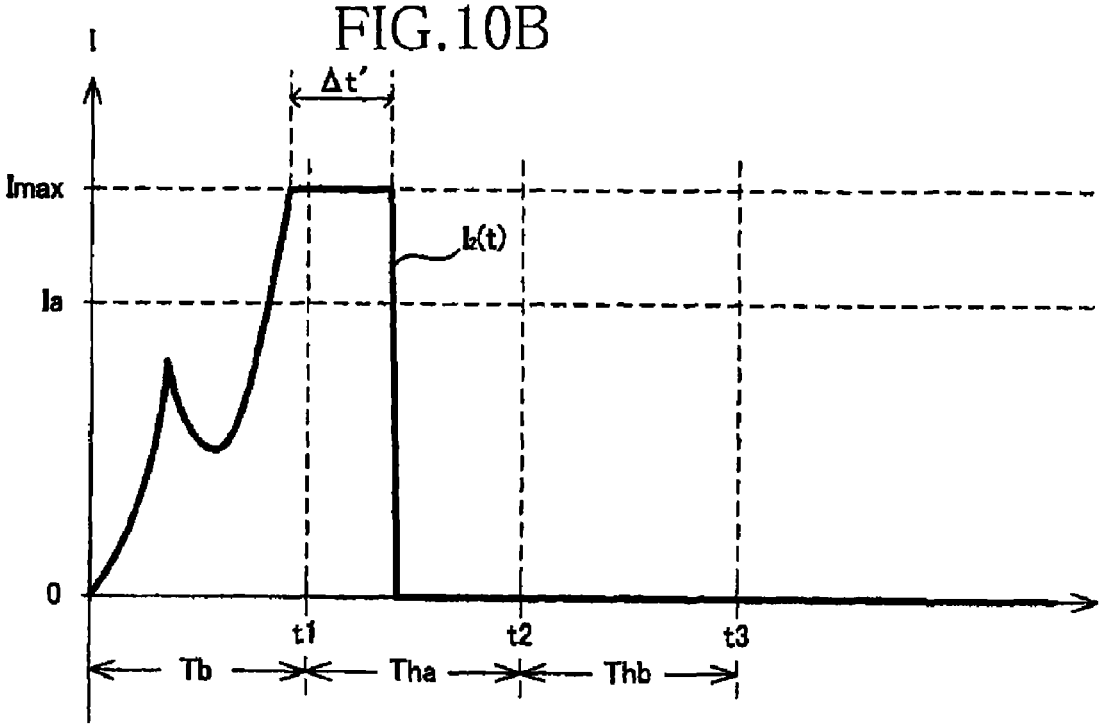
Figure 11A:
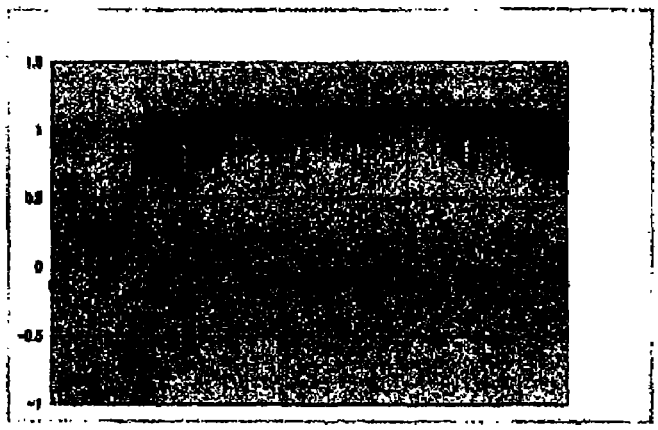
FIGS. 11A and 11B are views for showing a waveform ($I_3(t)$) representing, by way of example, a chronological change of an electric current I supplied to the electric motor when no media sheet remains in the sheet supply tray 20 and a coefficient of friction of a surface of a sheet supply roller 25 is lowered.
Figure 11B:
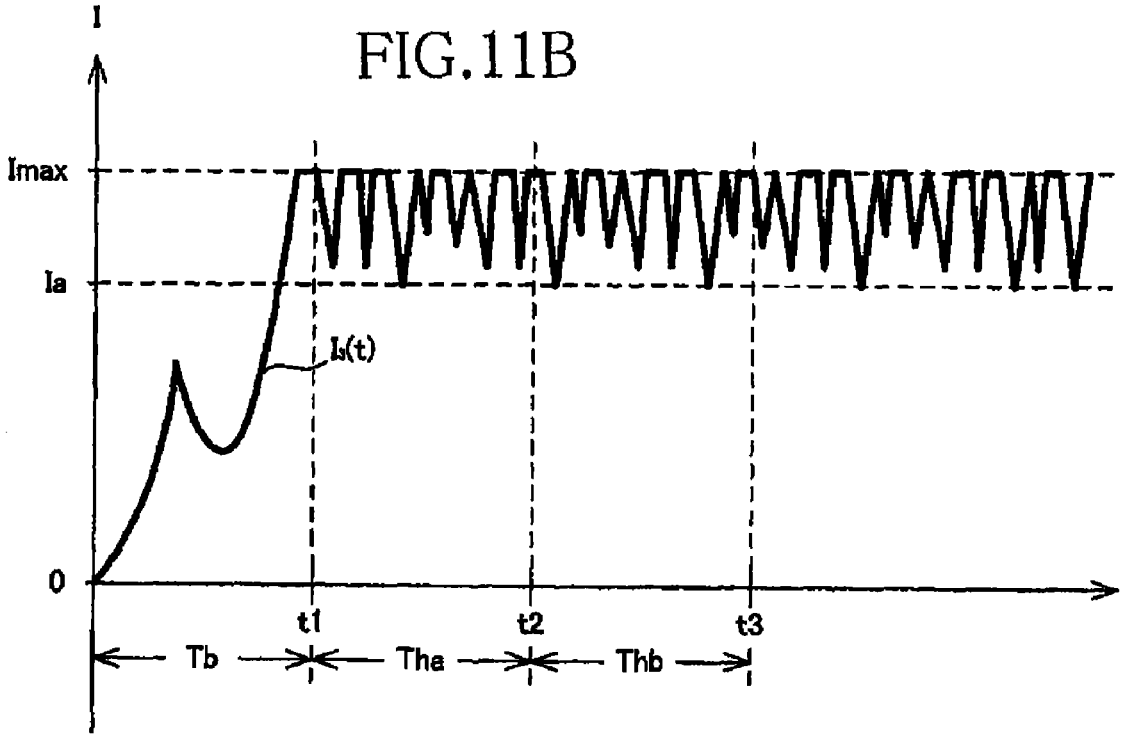

FIGS. 10A and 10B are views for showing a waveform $I_2(t)$ representing the chronological change of the motor electric current I supplied to the sheet supply motor 81 when no paper sheet remains in the sheet supply tray 20. FIG. 10A shows an actually measured data of the motor electric current I, while FIG. 10B schematically shows the measured data, for easier understanding. It is noted that FIG. 10A shows also a stage in which driving of the sheet supply motor 81 is retried after stopping of the motor 81. When no paper sheet is accommodated in the sheet supply tray 20, the sheet supply motor 81 is driven with the outer circumferential surface of the sheet supply roller 25 being held in pressing contact with the cork piece 19 that is disposed in the bottom of the sheet supply tray 20. In this instance, the sheet supply roller 25 cannot be rotated due to friction acting between the outer circumferential surface of the sheet supply roller 25 and the cork piece 19, while the motor electric current I supplied to the sheet supply motor 81 is increased duet to the feedback control performed by the motor controller 70. The waveform $I_2(t)$ shown in FIGS. 10A and 10B is a waveform in a case where the motor electric current I is rapidly increased to exceed the over-loaded electric current value Ia and then reach the maximum value Imax before the length of time t1 elapses whereby the sheet supply motor 81 is emergently stopped. Described more exactly, the sheet supply motor 81 is emergently stopped where the motor electric current I is held at the maximum value Imax for a predetermined length of time Δt'. It is therefore possible to determine whether at least one paper sheet is present in the sheet supply tray 20, by monitoring if the motor electric current I is smaller than the over-loaded electric current value Ia in the stage Tb, i.e, before the length of time t1 elapses, FIGS. 11A and 11B are views for showing a waveform $I_3(t)$ representing the chronological change of the motor electric current I supplied to the sheet supply motor 81 when no paper sheet remains in the sheet supply tray 20 and a coefficient of friction of the outer circumferential surface of the sheet supply roller 25 is lowered. FIG. 11A shows an actually measured data of the motor electric current I, while FIG. 11B schematically shows the measured data, for easier understanding. In general, after the roller 25 has been used for a large period of time, the roller 25 tends to suffer from paper pieces and/or dust sticking to its outer circumferential surface. The friction generated by the outer circumferential surface is reduced by the sticking paper pieces and/or dust, thereby causing slip motion of the roller 25. In this case, the roller 25 is intermittently rotated so that slip motion and stationary states of the roller 25 alternate with each other, whereby the motor electric current I is not stable and is represented by a waveform having a corrugated shape as shown in FIGS. 11A and 11B. Although the motor electric current I is held larger than the over-loaded electric current value Ia, the motor electric current I exceeds the maximum value Imax only instantaneously, so that the sheet supply motor 81 is not stopped, unlike in the case of FIGS. 10A and 10B. It is therefore possible to determine whether the roller 25 is slippingly rotated due to reduction in the friction of the outer circumferential surface of the roller 25, namely, whether a condition of the roller 25 should be checked, by seeing the waveform $I_3(t)$ having the corrugated shape that appears due to the reduction in the friction of the outer circumferential surface of the roller 25. In the present embodiment, the determination as to whether the roller 25 is slippingly rotated, namely, whether the condition of the roller 25 should be checked, is made by monitoring the time integral and derivative of the waveform $I_3(t)$ at least in the stage Tha corresponding to the period from the moment at which the length of time t1 elapses (from initiation of driving of the sheet supply motor 81) to the other moment at which the length of time t2 elapses (from the initiation of driving of the sheet supply motor 81). A threshold value Ia (t2–t1) used in the above-described determination based on the time integral is stored in the sixth threshold value register, while a threshold value K used in the above-described determination based on the time derivative is stored in the seventh threshold value register.

In a case where the sheet supply roller 25 is in the stationary state with its outer circumferential surface being held in contact with the cork piece 19, the motor electric current I is linearly increased. However, in a case where the slip motion and stationary states of the roller 25 alternate with each other, the motor electric current I is abruptly increased and reduced in synchronization with the alternate slip motion and stationary states of the roller 25. Therefore, there is an obvious difference between the former and latter cases with respect to the time derivative in the stage Tha. It is noted that the threshold value K is a suitably determined value that falls in a range between the time derivative in the former case and the time derivative in the latter case.

Figure 4:
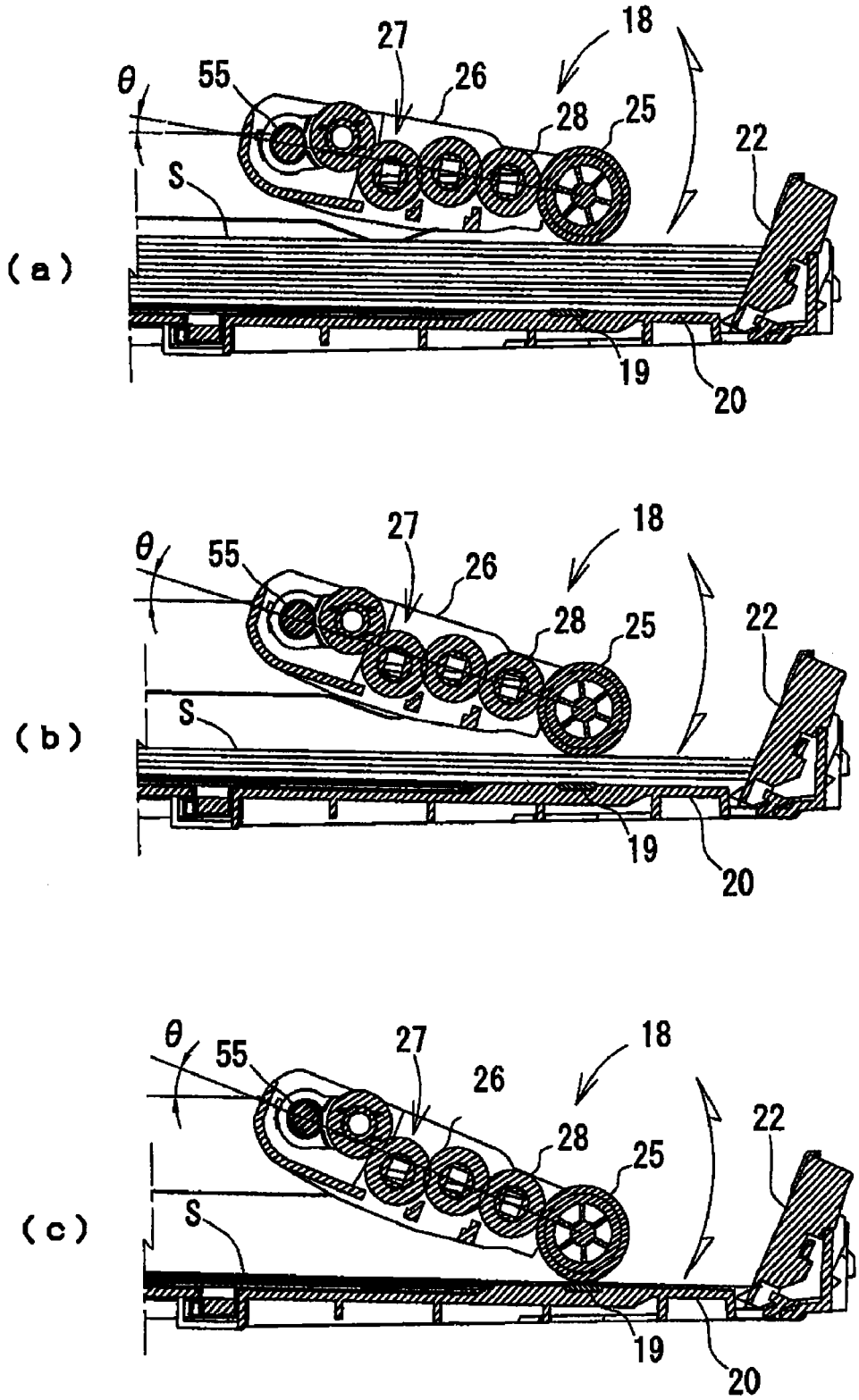
FIG. 4 is a set of views showing a sheet supply arm 26 that is inclined by an amount that varies depending upon a remaining amount of media sheets.
Figure 12A:
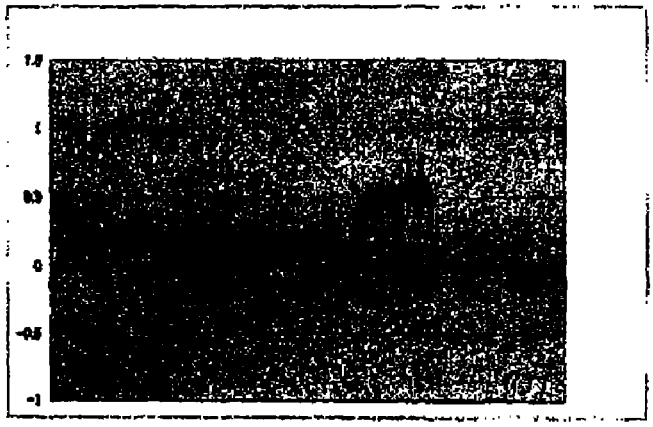
FIGS. 12A and 12B are views for showing a waveform ($I_4(t)$) representing, by way of example, a chronological change of an electric current I supplied to the electric motor when the amount of standard papers remaining in the sheet supply tray 20 is small.
Figure 12B:
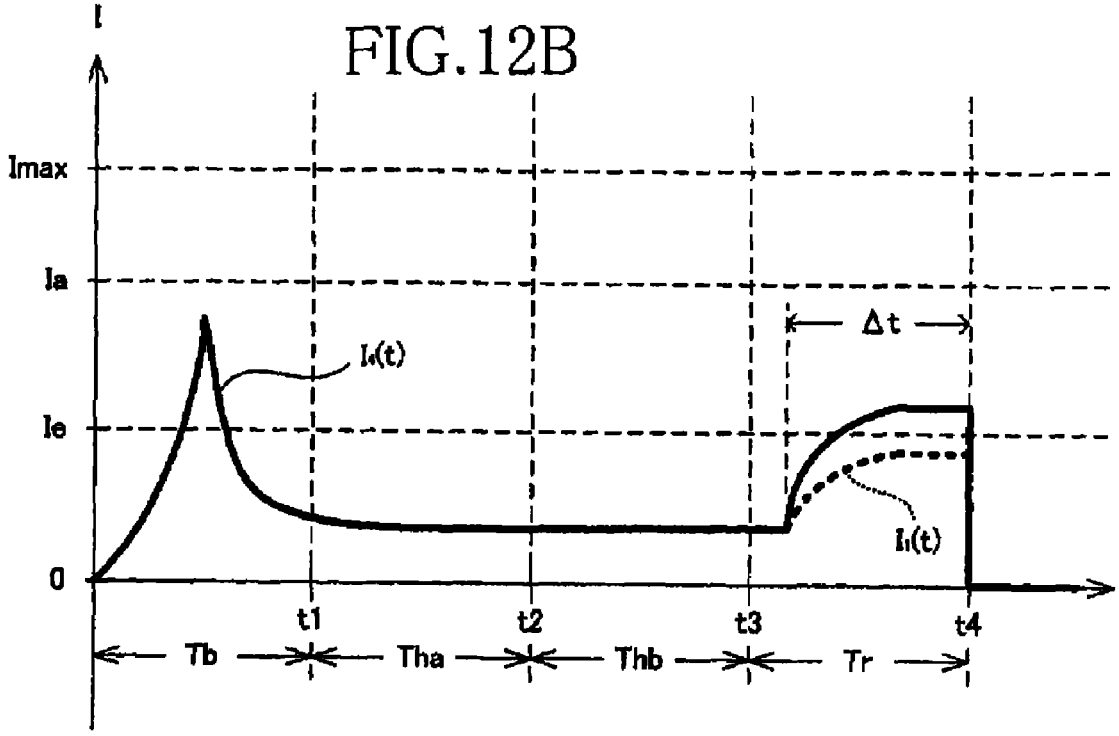

FIGS. 12A and 12B are views for showing a waveform $I_4(t)$ representing the chronological change of the motor electric current I supplied to the sheet supply motor 81 when a standard paper as the paper sheet is fed with only three standard papers being accommodated in the sheet supply tray 20. FIG. 12A shows an actually measured data of the motor electric current I, while FIG. 12B schematically shows the measured data, for easier understanding. It is noted that the above-described waveform $I_1(t)$ (indicated by broken line) as well as the waveform $I_4(t)$ (indicated by solid line) is shown in FIG. 12B. As shown in FIG. 4, the distal end portion of the sheet supply arm 26 is lowered as the amount of the paper sheets accommodated in the sheet supply tray 20 is reduced, whereby the inclination angle θ defined between the arm 26 and the accommodated paper sheets is increased, as described above. When the inclination angle θ is increased as a result of reduction in the number of the paper sheets, the load acting on the sheet supply motor 81 during the registering procedure in the stage Tr, whereby the motor electric current I is increased. This is apparent by comparing the waveform $I_4(t)$ with the waveform $I_1(t)$ in FIG. 12B. Thus, it can be said that the change in the inclination angle θ leads to change in the motor electric current I during the registering procedure. It is therefore possible to determine the amount of the remaining paper sheets by monitoring the motor electric current I in a stage (hereinafter referred to as "registering stage") in which the paper sheet is subjected to the registering procedure. It is noted that the motor electric current I during the registering stage varies depending upon the inclination angle θ but little varies depending upon type of the paper sheet. This is because, during the registering stage, the paper sheet is held stationary by the sheet feed roller 47 and the pinch roller 48 (that are disposed in an upper portion of the sheet feed path 23) while the sheet feed roller 25 is slippingly rotated. In the present embodiment, a threshold value Ie is predetermined and stored in the fifth threshold value register (see Table 3). The threshold value Ie is a value falling in a range between two values, one of which corresponds to the motor electric current I during the registering stage with the sheet supply tray 20 being fully loaded with the paper sheets, and the other of which corresponds to the motor electric current I during the registering stage with the sheet supply tray 20 is loaded with only three paper sheets.

Figure 13A:
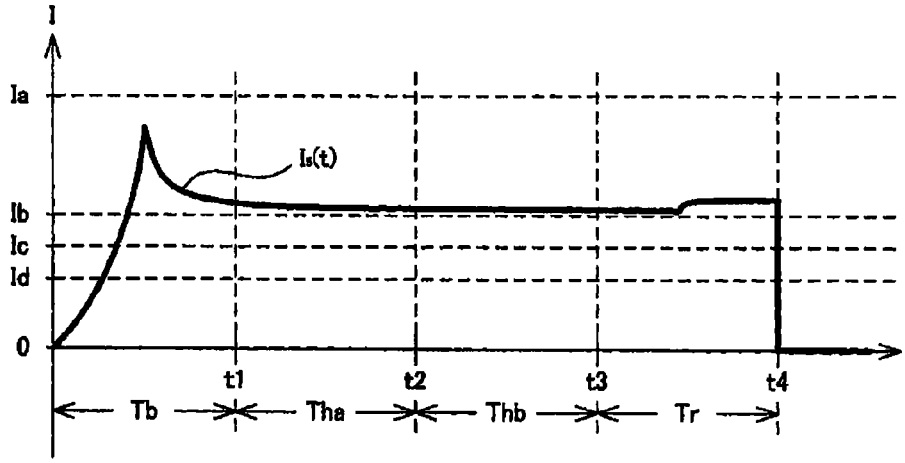
FIG. 13A is a view for showing a waveform ($I_5(t)$) representing, by way of example, a chronological change of an electric current I supplied to the electric motor when a glossy paper as a final media sheet is fed.
Figure 13B:
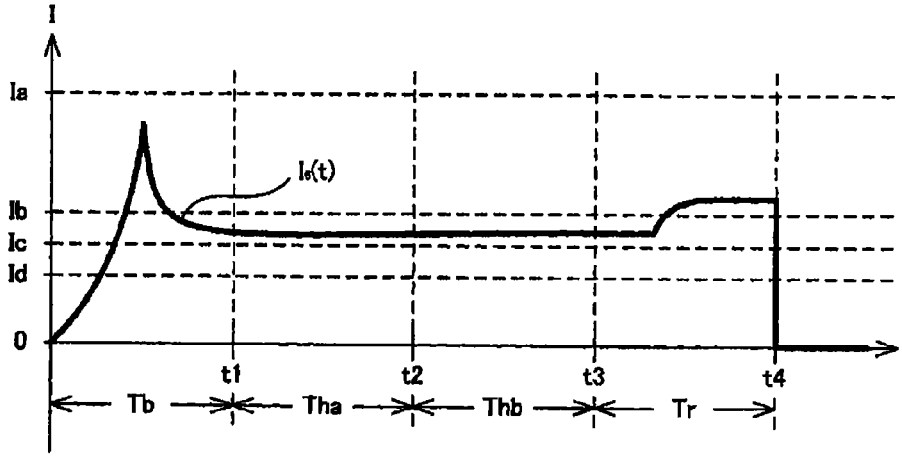
FIG. 13B is a view for showing a waveform ($I_6(t)$) representing, by way of example, a chronological change of an electric current I supplied to the electric motor when a standard paper as a final media sheet is fed.
Figure 13C:
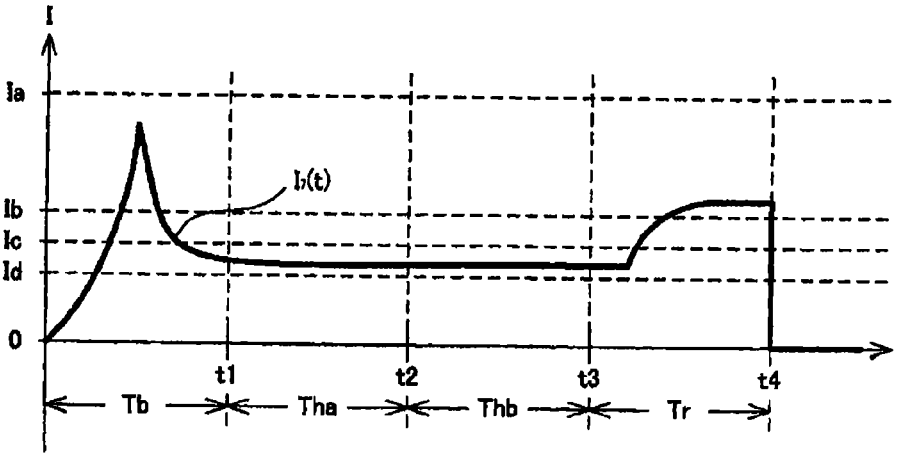
FIG. 13C is a view for showing a waveform ($I_7(t)$) representing, by way of example, a chronological change of an electric current I supplied to the electric motor when a glossy paper is fed while a sufficient amount of glossy papers remain in the sheet supply tray 20.

FIG. 13A is a view for showing a waveform $I_5(t)$ representing the chronological change of the motor electric current I supplied to the sheet supply motor 81 when a glossy paper as a final paper sheet is normally fed. FIG. 13B is a view for showing a waveform $I_6(t)$ representing the chronological change of the motor electric current I supplied to the motor 81 when a standard paper as a final media sheet is normally fed. FIG. 13C is a view for showing a waveform $I_7(t)$ representing the chronological change of the motor electric current I supplied to the motor 81 when a glossy paper is normally fed while a sufficient amount of glossy papers remain in the sheet supply tray 20. In each one of the cases of FIGS. 13A-13C, the motor electric current I is reduced to be converged to a certain value before the predetermined length of time T1 elapses from initiation of supply of the paper sheet (in a stage Tb). Then, the motor current value I is held in the certain value in a stage (corresponding to the stages Tha, Thb) from a moment at which the predetermined length of time T1 elapses (from the initiation of supply of the paper sheet) to another moment at which the predetermined length of time T3 elapses (from the initiation of supply of the paper sheet). This stage in which the motor current value I is held in the certain value is referred to as "variable stable stage" in the following descriptions.

There is a difference between the case of feeding the glossy paper and the case of feeding the standard paper with respect to the motor electric current I in the above-described variable stable stage, as is apparent by comparing the waveform $I_7(t)$ shown in FIG. 13C and the waveform $I_1(t)$ shown in FIG. 9B. As a factor causing this difference, there is a fact that a friction generated between the glossy papers is larger than a friction generated between the standard papers. As another factor, which is still larger than the above factor, is that the glossy paper has a rigidity larger than a rigidity of the standard paper. That is, comparing a case where the standard paper having a relatively small rigidity is fed along the sheet feed path 23 having the U shape as shown in FIG. 2, with a case where the glossy paper having a relatively large rigidity is fed along the U-shaped sheet feed path 23, the load acting on the sheet supply motor 81 is larger in the latter case than in the former case, whereby the motor electric current I is larger in the latter case than in the former case. Further, there is a difference also between the case of feeding the glossy paper as a final paper sheet and the case of feeding the standard paper as a final paper sheet with respect to the motor electric current I in the variable stable stage, as is apparent by comparing the waveform $I_5(t)$ shown in FIG. 13A and the waveform $I_6(t)$ shown in FIG. 13B. As a factor causing this difference, there is a fact that a friction generated between the glossy sheet and the cork piece 19 is larger than a friction generated between the standard sheet and the cork piece 19.

In view of the above-described facts as factors each causing the difference in the motor electric current I, it is possible to obtain information related to the paper sheet or sheets accommodated in the sheet supply tray 20 or fed by the feed mechanism, by monitoring the motor electric current I in the variable stable stage. For example, it is possible to determine the type of the paper sheet or sheets accommodated in the sheet supply tray 20 and to determine whether the currently fed paper sheet is a final sheet or not, by monitoring the motor electric current I in the variable stable stage. In the present embodiment, threshold values Ib, Ic, Id (Ia>Ib>Ic>Id) are predetermined and stored in the second, third and fourth threshold value registers, respectively (see Table 3).

Figure 7:
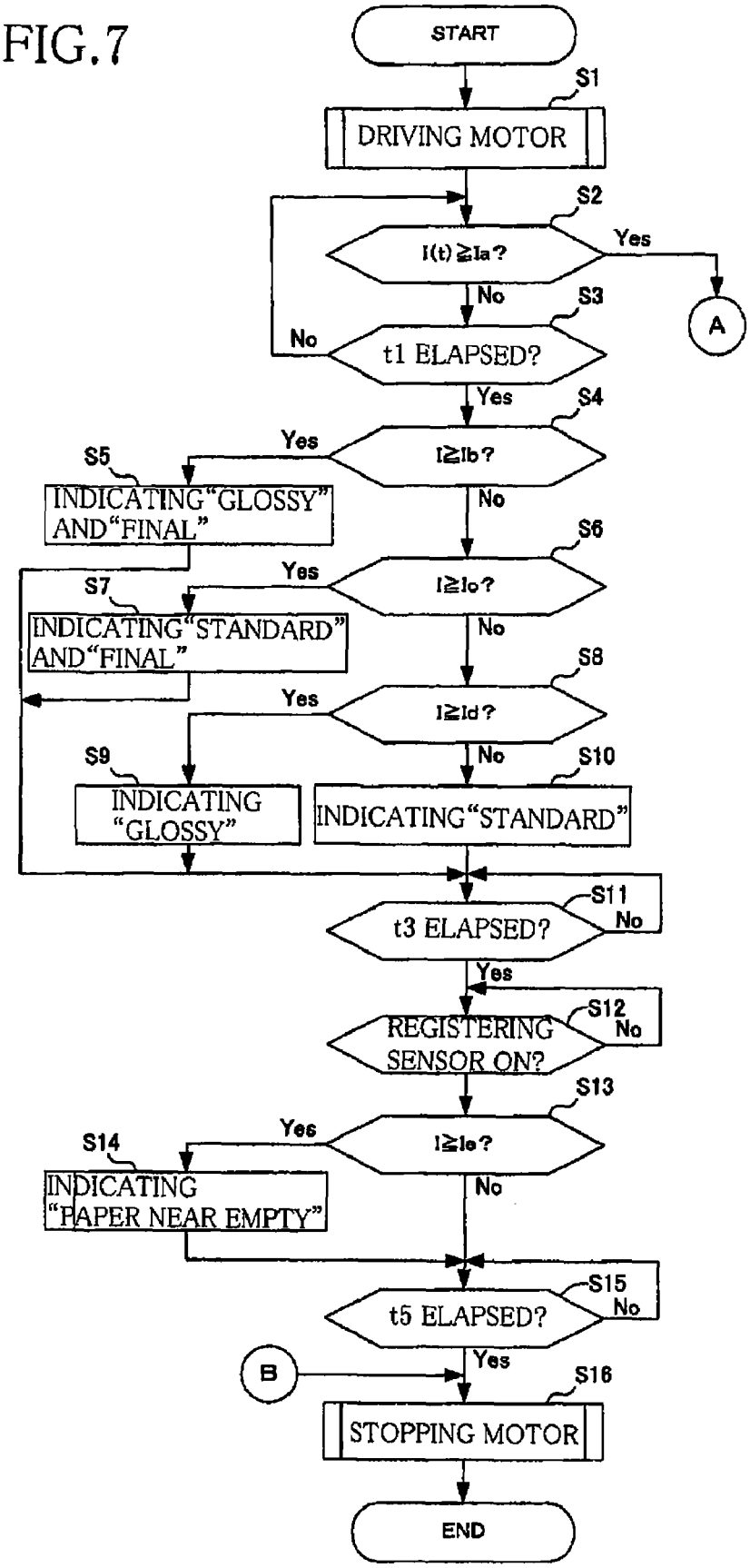
FIG. 7 is a flow chart showing a routine carried out under control of a CPU 61.
Figure 8:
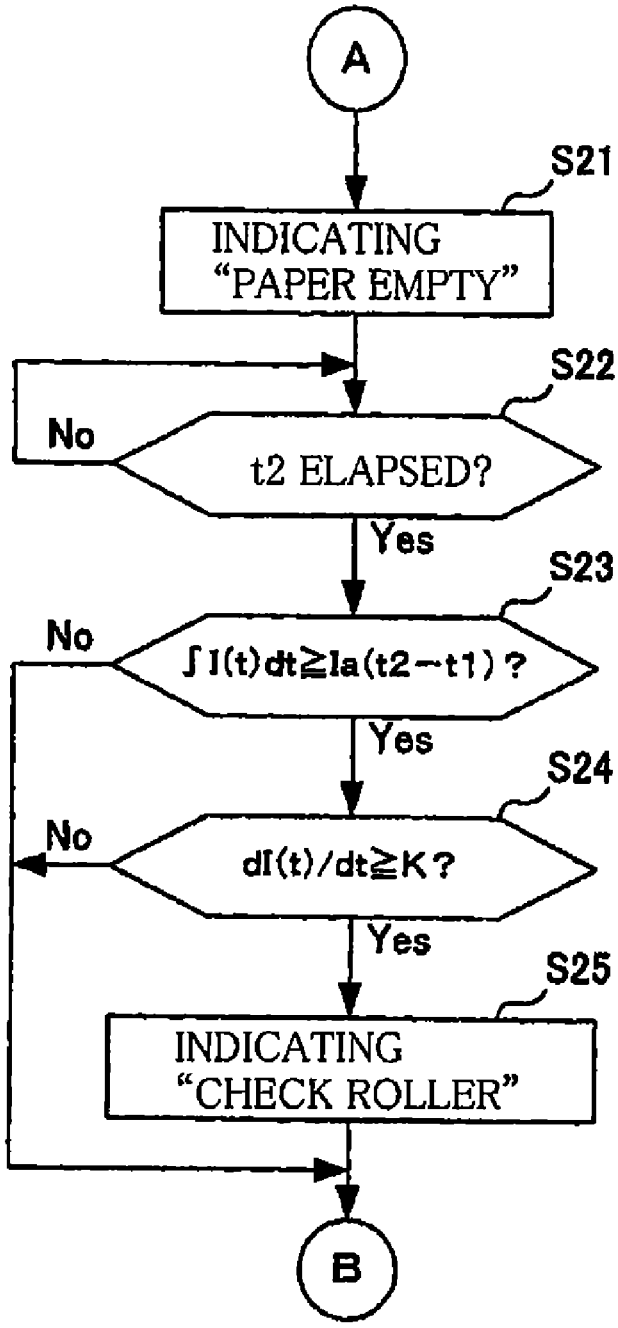
FIG. 8 is a flow chart showing a sub-routine carried out under control of the CPU 61.

Referring to FIGS. 9-13, there will be described, by way of examples, a main routine and a sub-routine practiced by the CPU 61 during supply of the paper sheets, for making various determinations. The routine is shown in a flow chart of FIG. 7, while the sub-routine is shown in a flow chard of FIG. 8. In FIGS. 7 and 8, each of steps S1, S2, S3, . . . indicates an order in which the steps are sequentially implemented. The routine is initiated with step S1 in response to a printing command inputted to the multifunction device 1.

In step S1, a motor driving procedure for driving the sheet supply motor 81 is carried out by the CPU 61. Described specifically, the values are set in the respective registers of the register unit 62 as shown in Table 3. Meanwhile, counting of the timer 68 (set in its initial value) is initiated, and at the same time the above-described motor drive signal for rotating the sheet supply motor 81 at the predetermined velocity $V_0$ is supplied to the motor controller 70. After the motor drive signal is inputted to the motor controller 70, the control signal (generated through the comparator circuit 73, PWM-signal generator circuit 75 and motor drive circuit 76 based on the motor drive signal) is supplied to the sheet supply motor 81. Thus, the sheet supply motor 81 is driven, and the drive force of the sheet supply motor 81 is transmitted to the sheet supply roller 25 via the drive-force transmission mechanism 27, whereby the sheet supply roller 25 is rotated at a predetermined velocity.

Step S1 is followed by step S2 in which it is determined by the CPU 61 whether the motor electric current I in the stage Tb is equal to or larger than the threshold value Ia. This determination is made for determining whether the paper sheet is absent in the sheet supply tray 20. Described specifically, the motor electric current I (into which the PWM signal is converted in the signal input portion 67) is compared with the threshold value Ia stored in the register unit 62. Then, one of the pattern values corresponding to result of the comparison is abstracted from Table 2, and one of the determination contents corresponding the abstracted pattern value is abstracted from Table 1. The procedure for determination using Tables 1 and 2 in each of steps S4, S6, S8, S13, S23, S24 is made in the same manner as in step S2. It is noted that a portion of the CPU 61 assigned to implement step S2 constitutes a media-presence determiner that is recited in claims appended hereto.

If an affirmative decision is obtained in step S2 (see FIGS. 10A and 10*b*), namely, if it is determined that no paper sheet is present in the sheet supply tray 20, the sub-routine is carried out, as shown in FIG. 8. The sub-routine is initiated with step S21 in which the LCD 11 is commanded by the CPU 61 to display a message saying that "PAPER EMPTY".

Step S21 is followed by step S22 that is implemented to determine whether the length of time t2 has elapsed from initiation of driving of the sheet feed motor 81. This determination is made based on counting by the timer 68.

If an affirmative decision is obtained in step S22, namely, if the length of time t2 has elapsed, step S22 is followed by step S23 in which it is determined by the CPU 61 whether the integral ∫I(t)dt of the waveform I(t) of the motor electric current in the stage Tha (from t1 to t2) is equal to or larger than the threshold value Ia (t2−t1) stored in the sixth threshold value register (see Table 3). If a negative decision is obtained in step S23, namely, if it is determined that the integral ∫I(t)dt is smaller than the threshold value Ia (t2−t1), the control flow goes to step S16 of the main-routine shown in FIG. 7, so that the sheet supply motor 81 is stopped by the CPU 61. Described specifically, in step S16, the CPU 61 outputs a motor stop signal for stopping drive of the sheet supply motor 81, and the motor stop signal is supplied to the motor controller 70, whereby the sheet supply motor 81 is stopped. In the present embodiment, the integral ∫I(t)dt is calculated by the integrator 85. However, the integral ∫I(t)dt may be otherwise obtained, for example, by a processing executed by the CPU 61 in accordance with a predetermined program.

On the other hand, if an affirmative decision is obtained in step S23, namely, if it is determined that the integral ∫I(t)dt is equal to or larger than the threshold value Ia (t2−t1), the control flow goes to step S24 in which it is determined by the CPU 61 whether the derivative dI(t)/dt of the waveform I(t) of the motor electric current in the stage Tha is equal to or larger than the threshold value K stored in the seventh threshold value register (see Table 3). In the present embodiment, the derivative dI(t)/dt is calculated by the differentiator 84. If a negative decision is obtained in step S24, namely, if it is determined that the derivative dI(t)/dt is smaller than the threshold value K, the control flow goes to step S16 of the main-routine shown in FIG. 7, so that the sheet supply motor 81 is stopped by the CPU 61. If it is determined that the derivative dI(t)/dt is equal to or larger than the threshold value K, due to appearance of the waveform $I_3(t)$ having the corrugated shape as shown in FIGS. 11A and 11*b*, it is determined that the sheet supply roller 25 is slid on the cork piece 19. In this case, step S24 is followed by step S25 in which the LCD 11 is commanded by the CPU 61 to display a message saying that "CHECK ROLLER", so that the user is informed of necessity of checking the condition of the sheet supply roller 25. After implementation of step S25, the control flow goes to step S16 of the main-routine shown in FIG. 7, so that the sheet supply motor 81 is stopped. It is noted that a portion of the CPU 61 assigned to implement steps S23, S24 constitutes a checking-need determiner that is recited in claims appended hereto.

On the other hand, if a negative decision is obtained in step S2, namely, if it is determined that the motor electric current I is smaller than the threshold value Ia, it is determined that at least one paper sheet is present in the sheet supply tray 20. In this instance, the amount of the paper sheets remaining in the tray 20 and the type of the paper sheets are not yet known. However, the remaining amount of the paper sheets and the type of the paper sheets are detected or determined by implementations of steps as described below.

The negative decision in step S2 is followed by step S3 that is implemented to determine whether the length of time T1 has elapsed from initiation of driving of the sheet supply motor 81. This determination is made based on counting by the timer 68. If it is determined that the length of time T1 has elapsed, the control flow goes to step S4. While the length of time $T_1$ has not elapsed, step S2 is repeatedly implemented. That is, step S2 is continuously implemented until the length of time $T_1$ elapses.

In step S4, it is determined by the CPU 61 whether the motor electric current I in the stage Thb is equal to or larger than the threshold value Ib. This determination is made after the length of time t2 has been counted by the timer 68. If it is determined that the motor electric current I is equal to or larger than the threshold value Ib (see FIG. 13A), the control flow goes to step S5 in which the LCD 11 is commanded by the CPU 61 to display "GLOSSY" (glossy paper) as information indicative of the type of the paper sheet and "FINAL" (final sheet) as information indicative of the amount of the paper sheet remaining in the sheet supply tray 20. In this instance, the LCD 11 may be commanded to display a message saying "SET PAPER" for advising the user to replenish the sheet supply tray 20 with new paper sheets. Step S5 is followed by step S11 that is described below. If it is determined in step S4 that the motor electric current I is smaller than the threshold Ib, the control flow goes to step S6. In the present embodiment, the LCD 11 cooperates with the CPU 61

(that commands the LCD 11 to indicate or display the various information) to constitute an indicator.

In step S6, it is determined by the CPU 61 whether the motor electric current I in the stage Thb is equal to or larger than the threshold value Ic. If it is determined that the motor electric current I is equal to or larger than the threshold value Ic (see FIG. 13B), the control flow goes to step S7 in which the LCD 11 is commanded by the CPU 61 to display "STANDARD" (standard paper) as information indicative of the type of the paper sheet and "FINAL" (final sheet) as information indicative of the amount of the paper sheet remaining in the sheet supply tray 20. Step S7 is followed by step S11. If it is determined in step S6 that the motor electric current I is smaller than the threshold Ic, the control flow goes to step S8.

In step S8, it is determined by the CPU 61 whether the motor electric current I in the stage Thb is equal to or larger than the threshold value Id. If it is determined that the motor electric current I is equal to or larger than the threshold value Id (see FIG. 13C), the control flow goes to step S9 in which the LCD 11 is commanded by the CPU 61 to display only "GLOSSY" (glossy paper) as information indicative of the type of the paper sheet. If it is determined that the motor electric current I is smaller than the threshold value Id, the control flow goes to step S10 in which the LCD 11 is commanded by the CPU 61 to display only "STANDARD" (standard paper) as information indicative of the type of the paper sheet. After implementation of step S8 or step S9, the control flow goes to step S11. It is noted that a portion of the CPU 61 assigned to implement steps S2, S6, S8 constitutes a media-type determiner that is recited in claims appended hereto.

Step S11 is implemented to determine whether the length of time $T_3$ has elapsed from initiation of driving of the sheet supply motor 81. If it is determined that the length of time $T_3$ has elapsed, the control flow goes to step S12. If it is determined that the length of time $T_3$ has not elapsed, step S11 is repeatedly implemented until the length of time $T_3$ elapses. It is noted that, where it is determined that the length of time $T_3$ has not elapsed, step S4 and other steps following step S4 may be implemented.

In step S12, it is determined by the CPU 61 whether the output signal of the register sensor 56 is ON. Step S12 is repeatedly implemented until the register sensor 56 is turned ON. This determination of step S12 is made for determining whether the paper sheet arrives in the nip position between the sheet feed roller 47 and the pinch roller 48. If it is determined in step S12 that the output signal of the register sensor 56 is ON, the control flow goes to step S13.

In step S13, it is determined by the CPU 61 whether the motor electric current I in the stage Ia (from t3 to t4) is equal to or larger than the threshold value Ie. This determination is made by determining an approximate amount of the paper sheets remaining in the sheet supply tray 20. While the motor electric current I in the stage Tr is monitored in the present embodiment, it is also possible to detect the motor electric current I after the output signal of the register sensor 56 is turned ON until the sheet supply motor 81 is stopped, as described below.

If it is determined in step S13 that the motor electric current I is equal to or larger than the threshold value Ie (see FIGS. 12A and 12B), step S13 is followed by step S14 in which the LCD 11 is commanded to display "PAPER NEAR EMPTY" as information indicative of the amount of the paper sheet remaining in the sheet supply tray 20. If it is determined in step S13 that the motor electric current I is smaller than the threshold value Ie, the control flow goes to step S15 without the LCD 11 being commanded to display any information, since the negative decision in step S13 indicates that a sufficiently amount of the paper sheets remain in the sheet supply tray 20. It is noted that a remaining-amount determiner that is recited in claims appended hereto may be considered to be constituted by a portion of the CPU 61 assigned to implement steps S4, S6, S8 and/or a portion of the CPU 61 assigned to implement step S13, since it is possible to interpret that the determination as to whether the currently fed paper sheet is a final sheet is included in the determination of the remaining amount of the paper sheets.

Step S15 is implemented to determine whether the length of time $T_4$ has elapsed from initiation of driving of the sheet supply motor 81. This determination is made, for example, by seeing if the predetermined length of time Δt elapses from turning ON of the output signal of the register sensor 56. The length of time Δt is a predetermined length of time that is required to carry out the registering procedure. If it is determined that the length of time $T_4$ has elapsed, the control flow goes to step S16 in which the sheet supply motor 81 is stopped. Described specifically, in response to turning ON of the output signal of the register sensor 56, the interrupt processor 63 supplies the interruption suspension signal to the CPU 61. When the interruption suspension signal is detected by the CPU 61, the CPU 61 supplies the motor stop signal to the motor controller 70, whereby the sheet supply motor 81 is stopped. Thus, one cycle of execution of the routine by the CPU 61 is terminated with step S16.

As described above, the remaining-amount determiner is constituted by the portion of the CPU 61 assigned to implement steps S4, S6, S8 and/or the portion of the CPU 61 assigned to implement step S13. However, it is also possible to interpret that the determination as to whether at least one paper sheet is present in the sheet supply tray 20 is included in the determination of the remaining amount of the paper sheets. In such an interpretation, the remaining-amount determiner may be constituted by the portion of the CPU 61 assigned to implement step S2, in addition to or in place of the portion or portions of the CPU 61 assigned to implement steps S4, S6, S8 and/or step S13.

While the presently preferred embodiment of the invention has been described above in detail, it is to be understood that the invention is not limited to the details of the illustrated embodiment, but may be otherwise embodied without departing from the spirit of the invention.

In the above-described embodiment, the type of the paper sheet (that is determined in steps S4, S6, S8) is simply displayed in the LCD 11. However, where a printing command is issued from a PC (that is connected to the multifunction device 1 via a LAN cable) while a desired printing condition (such as a desired type of the paper sheet and a desired quality level of image to be formed on the paper sheet) is set in a printer driver, it is possible to compare the determined type of the paper sheet with the desired type of the paper sheet. In this modified arrangement, if the determined type does not coincide with the desired type, it is possible to suspend the printing operation and/or to transmit information indicative of the operation suspension to the PC.

In the above-described embodiment, two types of paper sheets, i.e., the standard paper and the glossy paper are distinguished by the media-type determiner. However, the principle of the present invention is applicable also to distinguish more than two types or kinds of paper sheets including an inkjet paper and an OHP sheet.

What is claimed is:

1. A feeder device for feeding media sheets one after another along a feed path, comprising:

(a) an accommodator capable of accommodating the media sheets stacked therein;

(b) a feed mechanism including (b-1) a roller that is to be held in contact with the media sheets stacked in said accommodator and (b-2) an electric motor that is controllable based on a variable so as to rotate said roller, so that the media sheets can be fed along said feed path by said roller which is held in contact with the media sheets and which is rotated by said electric motor;

(c) a detector configured to detect an amount of rotation of one of said roller and said electric motor;

(d) a controller configured to adjust said variable on the basis of the amount of rotation detected by said detector such that feed movement of each of the media sheets along said feed path can be achieved substantially as desired;

(e) a monitor configured to monitor an actual value of said variable that is adjusted by said controller; and (f) a media-related information obtainer configured to obtain information related to the media sheets fed by said feed mechanism, based on the actual value of the adjusted variable monitored by said monitor, wherein said media-related information obtainer includes a media-type determiner configured to determine a type of the media sheets fed by said feed mechanism, based on the actual value of the adjusted variable monitored by said monitor.

2. The feeder device according to claim 1, wherein said media-type determiner determines the type of the media sheets fed by said feed mechanism, based on the actual value of said adjusted variable that is monitored in a stable stage of the feed movement of each of the media sheets in which said variable is held substantially constant.

3. The feeder device according to claim 1, further comprising a type-determination reference data storage storing a type-determination reference data indicative of a relationship between a reference value of said adjusted variable and the type of the media sheets to be fed by said feed mechanism, wherein said media-type determiner determines the type of the media sheets fed by said feed mechanism, based on the actual value of said adjusted variable monitored by said monitor and according to said type-determination reference data stored in said type-determination reference data storage.

4. The feeder device according to claim 1, further comprising:

a friction element disposed in a bottom portion of said accommodator so as to be opposed to said roller, such that a friction acting between said friction element and a lowermost one of the media sheets is larger than a friction acting between the media sheets; and a finality-determination reference data storage storing a finality-determination reference data indicative of a reference value of said adjusted variable that is to be monitored when a currently fed one of the media sheets is a final sheet that is slid on said friction element so as to be fed along said feed path, wherein said media-type determiner determines also whether each of the media sheets is the final sheet, based on the actual value of said adjusted variable monitored by said monitor and according to said finality-determination reference data stored in said finality-determination reference data storage.

5. The feeder device according to claim 1, further comprising, in addition to said media-type determiner, a remaining-amount determiner that is configured to determine an amount of the media sheets remaining in said accommodator, based on the actual value of said adjusted variable monitored by said monitor in a registering stage of the feed movement of each of the media sheets in which each of the media sheets is registered.

6. The feeder device according to claim 5, further comprising a remaining-amount determination reference data storage storing a remaining-amount determination reference data indicative of a relationship between a reference value of said adjusted value and the amount of the media sheets remaining in said accommodator, wherein said remaining-amount determiner determines the amount of the media sheets remaining in said accommodator, based on the actual value of said adjusted variable monitored by said monitor and according to said remaining-amount determination reference data stored in said remaining-amount determination reference data storage.

7. The feeder device according to claim 1, further comprising, in addition to said media-type determiner, a media-presence determiner that is configured to determine whether at least one of the media sheets is present in said accommodator, based on the actual value of said adjusted variable monitored by said monitor and an upper threshold value of the adjusted variable.

8. The feeder device according to claim 7, wherein said media-presence determiner determines that none of the media sheets is present in said accommodator, when the actual value of said adjusted variable monitored by said monitor exceeds the upper threshold value.

9. The feeder device according to claim 1, further comprising, in addition to said media-type determiner, a checking-need determiner that is configured to determine whether a condition of said roller needs to be checked, wherein said checking-need determiner is configured, when none of the media sheets is present in said accommodator, to determine whether the condition of said roller needs to be checked, by detecting a slip motion of said roller on a friction element disposed in a bottom portion of said accommodator, and wherein said checking-need determiner detects the slip motion of said roller on said friction element, based on the actual value of said adjusted variable that is monitored by said monitor.

10. The feeder device according to claim 9, wherein said checking-need determiner detects the slip motion of said roller on said friction element, based on at least one of a time integral of the actual value of said adjusted variable and a time derivative of the actual value of said adjusted variable.

11. The feeder device according to claim 1, further comprising an indicator to indicate information related to result of determination made by said media-type determiner.

12. The feeder device according to claim 1, wherein said variable adjusted by said controller is a value related to an electric power that is supplied to said electric motor.

13. A feeder device for feeding media sheets one after another along a feed path, comprising:

(a) an accommodator capable of accommodating the media sheets stacked therein;

(b) a feed mechanism including (b-1) a roller that is to be held in contact with the media sheets stacked in said accommodator and (b-2) an electric motor that is controllable based on a variable so as to rotate said roller, so that the media sheets can be fed along said feed path by said roller which is held in contact with the media sheets and which is rotated by said electric motor;

(c) a detector configured to detect an amount of rotation of one of said roller and said electric motor;

(d) a controller configured to adjust said variable on the basis of the amount of rotation detected by said detector such that feed movement of each of the media sheets along said feed oath can be achieved substantially as desired;

(e) a monitor configured to monitor an actual value of said variable that is adjusted by said controller; and (f) a media-related information obtainer configured to obtain information related to the media sheets fed by said feed mechanism, based on the actual value of the adjusted variable monitored by said monitor, wherein said media-related information obtainer includes a remaining-amount determiner configured to determine an amount of the media sheets remaining in said accommodator, based on the actual value of the adjusted variable monitored by said monitor.

14. The feeder device according to claim 13, wherein said remaining-amount determiner determines a type of the media sheets fed by said feed mechanism, in addition to said amount of the media sheets remaining in said accommodator.

15. The feeder device according to claim 13, wherein said remaining-amount determiner determines said amount of the media sheets remaining in said accommodator, based on the actual value of said adjusted variable and also a type of the media sheets fed by said feed mechanism.

16. The feeder device according to claim 13, further comprising, in addition to said remaining-amount determiner as a first remaining-amount determiner that is configured to determine the amount of the media sheets remaining in said accommodator based on the actual value of said adjusted variable monitored by said monitor in a stable stage of the feed movement of each of the media sheets in which said variable is held substantially constant, a second remaining-amount determiner that is configured to determine the amount of the media sheets remaining in said accommodator, based on the actual value of said adjusted variable monitored by said monitor in a registering stage of the feed movement of each of the media sheets in which each of the media sheets is registered.

17. The feeder device according to claim 16, wherein one of said first remaining-amount determiner and said second remaining-amount determiner determines whether each of the media sheets is a final sheet that is slid on a bottom portion of said accommodator so as to be fed along said feed path, and wherein the other of said first remaining-amount determiner and said second remaining-amount determiner determines whether a number of the media sheets remaining in said accommodator is larger than a predetermined amount.

18. The feeder device according to claim 16, further comprising a remaining-amount determination reference data storage storing a remaining-amount determination reference data indicative of a relationship between a reference value of said adjusted variable and the amount of the media sheets remaining in said accommodator, wherein said second remaining-amount determiner determines the amount of the media sheets remaining in said accommodator, based on the actual value of said adjusted variable monitored by said monitor in said registering stage and according to said remaining-amount determination reference data stored in said remaining-amount determination reference data storage.

19. The feeder device according to claim 13, further comprising, in addition to said remaining-amount determiner, a media-presence determiner that is configured to determine whether at least one of the media sheets is present in said accommodator, based on the actual value of said adjusted variable monitored by said monitor and an upper threshold value of the adjusted variable.

20. The feeder device according to claim 19, wherein said media-presence determiner determines that none of the media sheets is present in said accommodator, when the actual value of said adjusted variable monitored by said monitor exceeds the upper threshold value.

21. The feeder device according to claim 13, further comprising, in addition to said remaining-amount determiner, a checking-need determiner that is configured to determine whether a condition of said roller needs to be checked, wherein said checking-need determiner is configured, when none of the media sheets is present in said accommodator, to determine whether the condition of said roller needs to be checked, by detecting a slip motion of said roller on a friction element disposed in a bottom portion of said accommodator, and wherein said checking-need determiner detects the slip motion of said roller on said friction element, based on the actual value of said adjusted variable that is monitored by said monitor.

22. The feeder device according to claim 21, wherein said checking-need determiner detects the slip motion of said roller on said friction element, based on at least one of a time integral of the actual value of said adjusted variable and a time derivative of the actual value of said adjusted variable.

23. The feeder device according to claim 13, further comprising an indicator configured to indicate information related to result of determination made by said remaining-amount determiner.

24. The feeder device according to claim 13, wherein said variable adjusted by said controller is a value related to an electric power that is supplied to said electric motor.

* * * * *